US010711386B2

(12) United States Patent
Jang et al.

(10) Patent No.: US 10,711,386 B2
(45) Date of Patent: Jul. 14, 2020

(54) LAUNDRY TREATMENT APPARATUS AND METHOD OF CONTROLLING THE SAME

(71) Applicant: LG Electronics Inc., Seoul (KR)

(72) Inventors: Jaehyuk Jang, Seoul (KR); Sangwook Hong, Seoul (KR)

(73) Assignee: LG Electronics Inc., Seoul (KR)

( * ) Notice: Subject to any disclaimer, the term of this patent is extended or adjusted under 35 U.S.C. 154(b) by 47 days.

(21) Appl. No.: 16/059,124

(22) Filed: Aug. 9, 2018

(65) Prior Publication Data

US 2019/0048513 A1 Feb. 14, 2019

(30) Foreign Application Priority Data

Aug. 9, 2017 (KR) ..... 10-2017-0101335

(51) Int. Cl.
*D06F 39/04* (2006.01)
*D06F 33/00* (2020.01)
(Continued)

(52) U.S. Cl.
CPC ..... *D06F 39/045* (2013.01); *D06F 33/00* (2013.01); *D06F 35/00* (2013.01); *D06F 37/42* (2013.01);
(Continued)

(58) Field of Classification Search
CPC ..... D06F 39/04; D06F 39/045; D06F 33/02; D06F 35/00; D06F 37/42; D06F 58/28;
(Continued)

(56) References Cited

U.S. PATENT DOCUMENTS 2,511,839 A * 6/1950 Frye ..... D06F 58/26 34/255
2,886,618 A * 5/1959 Goldsmid ..... H01L 35/16 136/204
(Continued)

FOREIGN PATENT DOCUMENTS

DE 102008043281 5/2010
DE 102016110859 6/2017
(Continued)

OTHER PUBLICATIONS

International Search Report in International Application No. PCT/KR2018/009134, dated Nov. 27, 2018, 11 pages.
(Continued)

*Primary Examiner* — Stephen M Gravini
(74) *Attorney, Agent, or Firm* — Fish & Richardson P.C.

(57) ABSTRACT

Disclosed is a laundry treatment apparatus, which directly heats a drum accommodating laundry therein, and which is enhanced in efficiency and safety. The laundry treatment apparatus includes a drum formed of a metal material and provided to accommodate laundry therein, an induction module spaced apart from a circumferential surface of the drum and provided to heat the circumferential surface of the drum via a magnetic field that is generated when current is applied to a coil, a lifter provided in the drum to move the laundry inside the drum when the drum rotates, and a module controller configured to control an output of the induction module so as to control an amount of heat generated from the circumferential surface of the drum. The module controller variably controls the amount of heat that is generated based on a change in a position of the lifter that occurs when the drum rotates.

19 Claims, 13 Drawing Sheets

(51) Int. Cl.

| | |
|---|---|
| ***D06F 58/30*** | (2020.01) |
| ***D06F 35/00*** | (2006.01) |
| ***D06F 37/42*** | (2006.01) |
| ***D06F 37/06*** | (2006.01) |
| ***D06F 105/28*** | (2020.01) |

(52) U.S. Cl.
CPC ..... *D06F 58/30* (2020.02); *D06F 37/06* (2013.01); *D06F 39/04* (2013.01); *D06F 2105/28* (2020.02); *D06F 2202/12* (2013.01); *D06F 2204/04* (2013.01)

(58) Field of Classification Search
CPC ..... D06F 37/06; D06F 2058/289; D06F 2202/12; D06F 2204/04
USPC ..... 34/595–610, 247
See application file for complete search history.

(56) References Cited

U.S. PATENT DOCUMENTS 3,402,576 A * 9/1968 Krupsky ..... D06F 33/02 68/4
5,724,750 A * 3/1998 Burress ..... D06F 58/02 34/267
5,899,005 A * 5/1999 Chen ..... D06F 58/02 34/528
7,526,879 B2 * 5/2009 Bae ..... D06F 58/206 34/239
8,065,816 B2 * 11/2011 Ricklefs ..... D06F 58/04 137/512.15
8,276,290 B2 * 10/2012 Uhara ..... D06F 25/00 34/275
8,387,274 B2 * 3/2013 Ashrafzadeh ..... D06F 58/04 34/528
8,732,979 B2 * 5/2014 Ashrafzadeh ..... D06F 58/04 34/601
9,372,031 B2 * 6/2016 Contarini ..... D06F 58/206
9,745,687 B2 * 8/2017 Miller ..... H05B 3/0071
9,816,756 B2 * 11/2017 Paderno ..... D06F 58/24
10,179,966 B2 * 1/2019 Kim ..... D06F 25/00
2004/0250442 A1 * 12/2004 Ryu ..... D06F 25/00 34/140
2005/0138973 A1 * 6/2005 Hong ..... D06F 25/00 68/19.1
2005/0188471 A1 * 9/2005 Ahn ..... D06F 25/00 8/158
2005/0229647 A1 * 10/2005 Kim ..... D06F 25/00 68/20
2006/0169006 A1 * 8/2006 Lim ..... D06F 37/267 68/13 R
2006/0225467 A1 * 10/2006 Lim ..... D06F 25/00 68/20
2007/0220776 A1 9/2007 Guinibert et al.
2008/0216249 A1 * 9/2008 Sa ..... D06F 25/00 8/158
2014/0123403 A1 * 5/2014 Zattin ..... D06F 25/00 8/137
2019/0048509 A1 * 2/2019 Kim ..... D06F 23/04
2019/0048510 A1 * 2/2019 Kim ..... D06F 37/267
2019/0048511 A1 * 2/2019 Kim ..... H05B 6/102
2019/0048512 A1 * 2/2019 Noh ..... D06F 33/02
2019/0048513 A1 * 2/2019 Jang ..... D06F 35/00
2019/0048515 A1 * 2/2019 Noh ..... D06F 58/04
2019/0048517 A1 * 2/2019 Park ..... D06F 58/26

FOREIGN PATENT DOCUMENTS

EP 3287559 A1 * 2/2018 ..... D06F 25/00
EP 3441511 A1 * 2/2019 ..... D06F 35/00
KR 101223437 3/2007
KR 1020130017216 2/2013
KR 1020130044741 5/2013
KR 1020140087230 7/2014
WO WO-2018038380 A1 * 3/2018 ..... D06F 25/00
WO WO-2019031896 A1 * 2/2019 ..... D06F 35/00

OTHER PUBLICATIONS

European Extended Search Report in European Application No. 18188218.4, dated Dec. 10, 2018, 8 pages.

* cited by examiner

LAUNDRY TREATMENT APPARATUS AND METHOD OF CONTROLLING THE SAME

This application claims the benefit of Korean Patent Application No. 10-2017-0101335, filed on Aug. 9, 2017, which is hereby incorporated by reference as if fully set forth herein.

BACKGROUND OF THE INVENTION

Field of the Invention

The present invention relates to a laundry treatment apparatus, which directly heats a drum accommodating laundry therein, and which is enhanced in efficiency and safety.

Discussion of the Related Art

A laundry treatment apparatus is an apparatus for treating laundry and has functions to wash, dry, and refresh laundry.

There are various types of laundry treatment apparatuses, such as a washing machine that is mainly for washing laundry, a washing machine that is mainly for drying, and a refresher that is mainly for refreshing.

Then, there is a laundry treatment apparatus capable of performing at least two laundry treatments among washing, drying, and refreshing. For example, a single washing and drying machine may perform all of washing, drying, and refreshing.

In recent years, there has been provided a laundry treatment apparatus that incorporates two treatment apparatuses so that the two treatment apparatuses perform washing at the same time, or perform washing and drying at the same time.

The laundry treatment apparatus may generally include a heating device that heats wash water or air. Heating of the wash water may be performed to raise the temperature of wash water so as to promote activation of a detergent and accelerate decomposition of contaminants, thereby enhancing washing performance. Heating of the air may be performed to dry wet laundry by applying heat to the wet laundry so as to evaporate moisture.

In general, the heating of the wash water is performed via an electric heater, which is mounted on a tub in which the wash water is accommodated. The electric heater is immersed in the wash water, and the wash water includes foreign substances and detergents. Therefore, foreign substances, such as scale, may accumulate on the electric heater, which may degrade the performance of the electric heater.

In addition, the heating of the air requires a separate element, such as a fan for forcibly generating movement of the air and a duct for guiding the movement of the air. For example, an electric heater or a gas heater may be used for heating the air. In general, the efficiency of such an air heating method is not high.

In recent years, there has been provided a drying machine for heating air using a heat pump. The heat pump utilizes the cooling cycle of an air conditioner in reverse, and thus requires the same elements as those of an air conditioner, namely an evaporator, a condenser, an expansion valve, and a compressor. Unlike the air conditioner in which a condenser is used in an indoor unit to lower the temperature of indoor air, the drying machine using the heat pump is configured to dry laundry by heating air in an evaporator. However, such a drying machine using the heat pump has a complicated configuration and increased manufacturing costs, which is problematic.

In such a variety of laundry treatment apparatuses, an electric heater, a gas heater, and a heat pump, which serve as a heating device, have advantages and disadvantages, respectively, and concepts for a laundry treatment apparatus that uses induction heating as a new heating method capable of further highlighting the advantages of the aforementioned devices and compensating for the disadvantages thereof have been provided (Japanese Patent Registration No. JP2001070689 and Korean Patent Registration No. KR10-922986).

However, the related art discloses only basic concepts for performing induction heating in a washing machine, and does not propose specific constituent elements of an induction heating module, connections or operational relationships with basic constituent elements of the laundry treatment apparatus, or specific methods and configurations for enhancing efficiency and securing safety.

Therefore, it is necessary to provide a variety of specific technical ideas for enhancing efficiency and securing safety of the laundry treatment apparatus to which an induction heating principle is applied.

SUMMARY OF THE INVENTION

Accordingly, the present invention is directed to a laundry treatment apparatus and a method of controlling the same that substantially obviate one or more problems due to limitations and disadvantages of the related art.

It is an object of the present invention to provide a laundry treatment apparatus that is enhanced in efficiency and safety while using induction heating.

According to an embodiment of the present invention, it is an object to provide a laundry treatment apparatus that effectively prevents overheating from occurring in a lifter provided in a drum, thereby enhancing safety and a method of controlling the same. In particular, it is an object to provide a laundry treatment apparatus that faithfully maintains the basic functions of a lifter and enhances stability and a method of controlling the same.

According to an embodiment of the present invention, it is an object to provide a laundry treatment apparatus that is capable of preventing overheating from occurring in a portion of a drum in which a lifter is mounted without changing the shapes of the drum and the lifter and a method of controlling the same.

According to an embodiment of the present invention, it is an object to provide a laundry treatment apparatus that is capable of grasping the position of a lifter and reducing the amount of heat generated in a portion of the circumferential surface of a drum corresponding to the lifter, thereby reducing energy loss and preventing breakage of the lifter and a method of controlling the same.

According to an embodiment of the present invention, it is an object to provide a laundry treatment apparatus that is capable of uniformly heating a space in which laundry is accommodated by performing heating not only on a drum but also on a lifter. In particular, it is an object to provide a laundry treatment apparatus that is capable of preventing overheating of a lifter by lowering the heating temperature of a portion of a drum in which the lifter is mounted relative to that of a remaining portion of the drum in which the lifter is not mounted and capable of increasing heating efficiency by allowing heat transfer through the lifter and a method of controlling the same.

According to an embodiment of the present invention, it is an object to provide a laundry treatment apparatus that is enhanced in stability and efficiency while minimizing changes in the shape and structure of a conventional drum and lifter and a method of controlling the same.

According to an embodiment of the present invention, it is an object to provide a laundry treatment apparatus that controls the output of an induction module based on a sensed or estimated position of a lifter, thereby preventing overheating of the lifter and increasing heating efficiency and a method of controlling the same.

Additional advantages, objects, and features will be set forth in part in the description which follows and in part will become apparent to those having ordinary skill in the art upon examination of the following or may be learned from practice. The objectives and other advantages may be realized and attained by the structure particularly pointed out in the written description and claims hereof as well as the appended drawings.

To achieve these objects and other advantages in accordance with the purpose of the invention, as embodied and broadly described herein, in accordance with one aspect of the present invention, a laundry treatment apparatus includes a drum formed of a metal material and provided to accommodate laundry therein, an induction module spaced apart from a circumferential surface of the drum and provided to heat the circumferential surface of the drum via a magnetic field that is generated when current is applied to a coil, a lifter provided in the drum to move the laundry inside the drum when the drum rotates, and a module controller configured to control an output of the induction module so as to control an amount of heat generated from the circumferential surface of the drum, wherein the module controller variably controls the amount of heat that is generated based on a change in a position of the lifter that occurs when the drum rotates.

The module controller may perform control so that an amount of heat in the drum at a facing position of the lifter, at which the lifter faces the induction module, is less than an amount of heat in the drum at a position of the lifter deviating from the facing position.

Specifically, the module controller may reduce the output of the induction module to zero or to be lower than a normal output when the lifter is positioned to face the induction module and may perform control so that the output of the induction module is the normal output when the lifter is not positioned to face the induction module.

The lifter may be mounted on an inner peripheral surface of the drum. Specifically, the lifter may be formed of a plastic material.

In order to sense the position of the lifter, the laundry treatment apparatus may further include a magnet provided in the drum so that a position thereof relative to the lifter is fixed, and a sensor provided at a fixed position outside the drum to sense the position of the lifter by sensing a change in the position of the magnet as the drum rotates.

When the rotation angle of the cylindrical drum ranges from 0 degrees to 360 degrees, by sensing the position of the magnet, the position of the lifter, provided to form a predetermined angle with the position of the magnet, may be estimated.

The sensor may include a reed switch or a hall sensor configured to output different signals or flags according to whether or not the magnet is sensed.

The magnet may be provided on the drum, and the sensor may be provided on the tub. In order to minimize the effect of the magnetic field generated from the induction module, the sensor may be mounted on the tub at a position opposite to a position on the tub at which the induction module is mounted.

The laundry treatment apparatus may further include a main controller configured to control driving of a motor that rotates the drum, and the main controller may be provided so as to communicate with the module controller.

The lifter may include a plurality of lifters provided in a circumferential direction of the drum. The magnet may be provided in the same number as the lifter, and the sensor may sense the position of each lifter by sensing the position of a corresponding magnet and may transmit a sensing output to the module controller.

In one example, when three lifters are provided, three magnets may be provided. The lifters and the magnets may be located at the same angular distance. Thus, when one magnet is sensed, the position of the adjacent lifter may be estimated. In this case, it is possible to relatively accurately estimate the position of each lifter even for a period during which the RPM of the drum varies.

The magnet may be provided only in a singular number regardless of a number of the lifters, and the sensor may be provided to sense the position of a specific lifter by sensing the position of the magnet and transmit an output to the main controller, and the main controller may be provided to estimate the position of each of the remaining lifters via the output of the sensor and a rotation angle of the motor.

This is economical because the number of magnets may be reduced. When the position of any one lifter is estimated based on the position of the magnet, it is possible to relatively accurately estimate the positions of the remaining lifters in consideration of the current RPM and the angle between the respective lifters. However, it may be difficult to accurately estimate the positions of the lifters for a period during which the RPM of the drum varies.

The circumferential surface of the drum may be formed with an embossing pattern repeated along the circumferential surface, and formation of the embossing pattern may be eliminated on a portion of the circumferential surface of the drum on which the lifter is mounted.

The embossing pattern protrudes from or is recessed in the circumferential surface of the drum. Thus, a portion in which the embossing pattern is formed may have a smaller area of a surface thereof that faces the induction module, compared to the other portion in which the embossing pattern is not formed. Thus, at a point in time at which the embossing pattern faces the induction module, the value of current flowing in the induction module or the output (power) of the induction module may increase.

On the other hand, a portion of the circumferential surface of the drum corresponding to a lifter mounting portion in which the lifter is mounted faces the induction module over a larger area and is spaced apart from the induction module by a smaller distance. Thus, the value of current flowing in the induction module or the output of the induction module may decrease.

The embossing pattern and the lifter mounting portion are repeatedly and regularly formed in the circumferential direction of the drum. Thus, it is possible to estimate the position of the lifter based on a change in the current or the output of the induction module depending on the rotation angle of the drum. That is, it is possible to relatively accurately estimate the position of the lifter even when a sensor is not provided to sense the rotation angle of the drum.

That is, the module controller may be provided to estimate the position of the lifter via a change in power or current of the induction module due to presence or absence of the embossing pattern facing the induction module that occurs when the drum rotates. In other words, it is possible to estimate the position of the lifter based on a change in the output of the induction module from the module controller that controls the output of the induction module.

In order to achieve the objects described above, according to another aspect of the present invention, a method of controlling a laundry treatment apparatus including a drum formed of a metal material and provided to accommodate laundry therein, an induction module spaced apart from a circumferential surface of the drum and provided to heat the circumferential surface of the drum via a magnetic field that is generated when current is applied to a coil, a lifter provided in the drum to move the laundry inside the drum when the drum rotates, and a module controller configured to control an output of the induction module so as to control an amount of heat generated from the circumferential surface of the drum, includes operating the induction module, controlling, by the module controller, the induction module to generate a normal output, sensing a position of the lifter, and reducing the output of the induction module by the module controller when the position of the lifter is sensed.

The method may further include determining whether or not to perform the reducing regardless of whether or not the position of the lifter is sensed.

The determining whether or not to perform the reducing is performed based on a rotational speed of the drum or based on the operation that is being performed.

When the rotational speed of the drum is equal to or greater than a spin speed, which is higher than a tumbling speed, the laundry rotates in close contact with the inner peripheral surface of the drum. The tumbling speed means a speed at which the laundry is lifted by the lifter when the drum rotates. When the rotational speed of the drum becomes greater than the tumbling speed and reaches the spin speed, the centrifugal force becomes greater than acceleration due to gravity, and the laundry is in close contact with the inner peripheral surface of the drum to integrally rotate with the drum without falling down.

When the laundry is in close contact with the inner peripheral surface of the drum, this means that heat transfer between the drum and the laundry may continue. Thus, in this case, it is not necessary to variably control the output of the induction module.

In the determining whether or not to perform the reducing, when the rotational speed of the drum is equal to or less than a predetermined speed, the reducing may be performed. When the rotational speed of the drum exceeds the predetermined speed, the reducing may not be performed. The predetermined speed may be, for example, 200 RPM.

The laundry treatment apparatus may further include a tub configured to accommodate the drum and store wash water therein, and, in the determining, the reducing is not performed in a washing operation in which the wash water is stored in the tub.

In the case of the washing operation, a portion of the circumferential surface of the drum is immersed in the wash water inside the tub. Thus, when the drum rotates, heat generated in the drum may be very effectively transferred to the wash water. Hence, in the case of the washing operation, control for a reduction in output may not be necessary.

The reducing may be performed when a facing position of the lifter at which the lifter faces the induction module is sensed in the sensing.

In the reducing, the output may be controlled so as to be less than the normal output, or is turned off.

The method may further include sensing a value of current flowing in the induction module or power of the induction module, and the sensing the position of the lifter may include estimating the position of the lifter via a change in the value of current or the power. This may be very economical because no sensor is required.

The laundry treatment apparatus may further include a magnet provided in the drum so that a position thereof relative to the lifter is fixed, and a sensor provided at a fixed position outside the drum to sense the position of the lifter by sensing a change in a position of the magnet as the drum rotates, and the sensing may include sensing the position of the lifter based on an output value of the sensor.

The lifter may include a plurality of lifters provided in a circumferential direction of the drum at a constant interval, the laundry treatment apparatus may include a single magnet provided in the drum such that a position thereof relative to a specific lifter among the lifters is fixed, and a sensor provided at a fixed position outside the drum to sense a a position of the specific lifter by sensing a change in the position of the single magnet as the drum rotates, and the sensing may include sensing the position of the lifter based on an output value of the sensor and estimating a position of a remaining lifter based on a rotation angle of the drum or a rotation angle of a motor that drives the drum.

The reducing may be performed when a facing position of the lifter at which the lifter faces the induction module is sensed.

In the above-described embodiments, control may be performed so that the output of the induction module varies after the induction module is operated. That is, the output of the induction module may vary after the induction module reaches a normal output.

Due to the positional relationship between the induction module and the drum and the shapes of the induction module and the drum, the induction module substantially heats only a specific portion of the drum. Thus, when the induction module heats the drum that is in the stopped state, the specific portion of the drum may be heated to a very high temperature. Thus, it is necessary to rotate the drum in order to prevent overheating of the drum. That is, the drum may be rotated in order to change the portion thereof that is heated.

Accordingly, the drum may be rotated prior to operating the induction module. In a washing machine or a drying machine, the rotational speed of the drum is generally set to a rotational speed at which tumbling driving of the drum is possible. The drum is directly accelerated from the stopped state to the tumbling driving speed. In addition, for the tumbling driving, the drum may be rotated forward and in reverse. That is, the drum may stop after continuing tumbling driving in the clockwise direction, and then again perform tumbling driving in the counterclockwise direction.

Even when the rotational speed of the drum is very low, similarly, a specific portion of the drum may be overheated. For example, when the tumbling driving speed is 40 RPM, a predetermined time is consumed until the drum rotates from the stopped state to 40 RPM. Thus, the point in time at which the drum starts tumbling driving and the point in time at which the drum performs tumbling driving normally are different. That is, when the drum starts tumbling driving, the drum is gradually accelerated in the stopped state, and after reaching the tumbling RPM, is driven at the tumbling RPM. The drum may stop after performing tumbling driving in a certain direction, and then again perform tumbling driving in a different direction.

Here, it is necessary to prevent overheating of the drum and to increase heating energy efficiency and time efficiency.

It may be necessary to avoid heating for a period during which the RPM of the drum is very low in order to prevent overheating of the drum. On the other hand, when the drum is heated after the RPM of the drum reaches a normal range, time may be wasted.

Therefore, the point in time at which the induction module starts to operate may be after the drum starts to rotate and before the drum reaches a normal tumbling RPM. Of course, the induction module may be operated after the drum reaches the tumbling RPM because it is more important to prevent overheating of the drum.

In one example, the induction module may be operated when the drum RPM is greater than 30 RPM, but may not be operated when the drum RPM is less than 30 RPM.

That is, the induction module may be operated only when the drum RPM is greater than a specific RPM, and may not be operated when the drum RPM is less than the specific RPM.

Thus, for a normal tumbling driving period, the induction module is driven after the drum starts to rotate, and the driving of the induction module stops before the rotation of the drum stops. That is, the induction module may be turned on or off based on a predetermined RPM, which is less than a normal tumbling RPM.

Meanwhile, variable control of the induction module may be performed in the On state of the induction module.

In order to achieve the objects described above, according to another aspect of the present invention, a laundry treatment apparatus includes a drum formed of a metal material and provided to accommodate laundry therein, an induction module spaced apart from a circumferential surface of the drum and provided to heat the circumferential surface of the drum via a magnetic field that is generated when current is applied to a coil, and a lifter formed of a metal material and provided in the drum to move the laundry inside the drum when the drum rotates, wherein the lifter is provided so as to be recessed in a direction in which a distance between the induction module and the lifter, which face each other, increases.

When the surface of the lifter that faces the induction module is located further inward than the circumferential surface of the drum in the radial direction, it is possible to prevent overheating in a portion in which the lifter is provided. In this case, it may be unnecessary to variably control the output of the induction module according to the position of the lifter. In addition, since the surface of the lifter that faces the induction module may be heated, it is possible to reduce the heating time.

Such a change in the structures of the lifter and the drum for preventing overheating of the portion in which the lifter is provided may be applied together with variable control of the output of the induction module. In this case, the purpose of preventing overheating of the portion in which the lifter is provided may be further effectively achieved.

In order to achieve the objects described above, according to a further aspect of the present invention, a method of controlling a laundry treatment apparatus including a drum formed of a metal material and provided to accommodate laundry therein, an induction module spaced apart from a circumferential surface of the drum and provided to heat the circumferential surface of the drum via a magnetic field that is generated when current is applied to a coil, a lifter provided in the drum to move the laundry inside the drum when the drum rotates, and a module controller configured to control an output of the induction module so as to control an amount of heat generated from the circumferential surface of the drum, includes operating the induction module, stopping an operation of the induction module, determining whether to operate the induction module or to stop the operation of the induction module according to a rotational speed of the drum, and determining whether to operate the induction module or to stop the operation of the induction module according to the temperature of the drum.

The drum may start to rotate in the stopped state at a normal tumbling driving rotational speed. After the drum starts to rotate and is accelerated, the drum may continue to rotate at the tumbling driving rotational speed. Thus, after the drum rotates, the induction module may start to drive or stop the driving thereof based on a predetermined drum rotational speed, which is lower than the normal tumbling driving rotational speed.

When the induction module starts to drive, a step of controlling, by the module controller, the operation of the induction module to a normal output may be performed. Then, a step of sensing a position of the lifter may be performed. The method may include a step of reducing, by the module controller, the output of the induction module when the position of the lifter is sensed.

Thus, when tumbling driving of the drum is continued, the induction module may repeatedly undergo a normal output period and a reduced output period.

Then, the induction module is turned off before the tumbling driving ends. This is because the drum stops after being driven at a speed lower than the predetermined rotational speed.

When the drum again starts to rotate in an opposite direction, the rotational speed of the drum is sensed, and the induction module starts to drive. Normal output control, lifter position sensing, and reduced output control may be repeatedly performed until the driving of the induction module stops.

In this way, it is possible to prevent overheating of the drum, to prevent overheating of a specific portion of the drum in which the lifter is provided, and to increase time efficiency.

It is to be understood that both the foregoing general description and the following detailed description of the present invention are exemplary and explanatory and are intended to provide further explanation of the present invention as claimed.

BRIEF DESCRIPTION OF THE DRAWINGS

The accompanying drawings, which are included to provide a further understanding of the present invention and are incorporated in and constitute a part of this application, illustrate embodiment(s) of the present invention and together with the description serve to explain the principle of the present invention. In the drawings.

DETAILED DESCRIPTION OF THE INVENTION

Hereinafter, exemplary embodiments of the present invention will be described in detail with reference to the accompanying drawings.

The basic constituent elements of a laundry treatment apparatus and an induction heating principle, which are applicable to an embodiment of the present invention, will be described below with reference to FIGS. 1 and 2.

Figure 1:
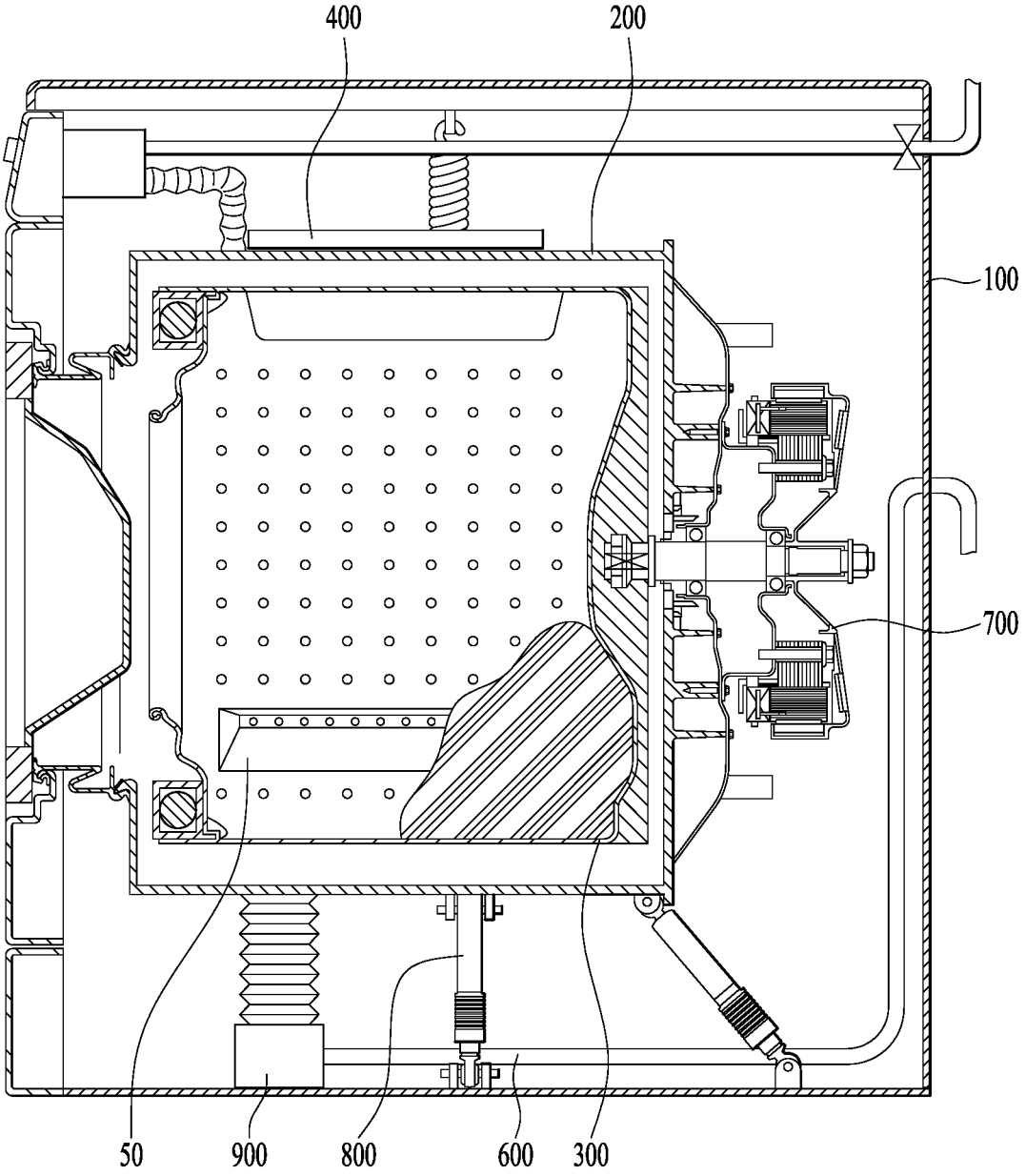
FIG. 1 illustrates a laundry treatment apparatus according to an embodiment of the present invention.

As illustrated in FIG. 1, the basic constituent elements of the laundry treatment apparatus according to the present embodiment may be the same as or similar to those of a general laundry treatment apparatus. However, unlike the general laundry treatment apparatus, an induction module 400 may be mounted to directly heat a drum 300. Since the induction module 400 is a heating device, any other heating device used in a general laundry treatment apparatus may be replaced or combined with the induction module 400.

The induction module 400 may include a coil 420, which forms a magnetic field upon receiving current. The coil 420 may be formed by winding a wire, and the winding direction of the wire, i.e., the direction in which the wire is wound, may be determined in a manner such that the area of a surface thereof that faces the outer peripheral surface of the drum 300 is as large as possible. In addition, the coil 420 may be positioned in a manner such that a mounting position thereof coincides with the center of the drum 300 to be heated by the coil 420. The winding direction and the mounting position of the coil 420 may be clearly understood through the induction heating principle, which will be described below.

When current is supplied to the coil 420, a magnetic field is generated in the winding direction of the coil 420. That is, a magnetic field is generated in the direction of the center axis of the coil 420. Here, when alternating current having a varying phase difference is applied to the coil 420, an alternating current magnetic field in which the direction of the magnetic field changes is formed. The alternating current magnetic field generates an induced magnetic field in a direction opposite to that thereof in an adjacent conductor, and a change in the induced magnetic field generates induced current in the conductor.

With the induced current and the induced magnetic field, energy is transferred from the induction module 400 to a neighboring conductor due to changes in an electric field and a magnetic field.

The drum 300 is formed of a metal material, and eddy current, which is a type of induced current, is generated in the drum 300 due to the induced magnetic field generated in the coil 420.

Electrical energy is converted into thermal energy by the resistance, i.e. inertia, to a change in induced current. That is, the drum 300 is heated. By this principle, the drum 300, which is spaced from the induction module 400, may be directly heated. According to this principle, it can be understood that the energy of the induction module 400 may be more effectively transferred to the drum 300 as the distance between the drum 300 and the induction module 400 decreases and the areas of the surfaces of the drum 300 and the induction module 400 that face each other increase.

In other words, it can be seen that the efficiency of heating of a specific area may be enhanced as the area is closer to the induction module 400 and becomes more closely parallel to the induction module 400.

The induction module 400 may be provided on the outer peripheral surface of a tub 200. Of course, the induction module 400 may be provided on the inner peripheral surface of the tub 200 so as to further reduce the distance between the induction module 400 and the drum 300. However, considering, for example, collision between the drum 300 that rotates and vibrates and the induction module 400 and damage to the induction module 400 due to the high-temperature and high-humidity environment inside the tub 200, the induction module 400 may be provided on the outer peripheral surface of the tub 200.

The tub 200 is mounted inside a cabinet 100, which forms the outer shape of the laundry treatment apparatus, and the drum 300 is rotatably mounted inside the tub 200. A motor 700 may be mounted on the rear surface of the tub 200 to drive the drum 300. Thus, the drum 300 rotates inside the tub 200 by driving the motor 700.

The tub 200 is supported relative to the cabinet 100 by a support device 800, such as a damper or a spring. The support device 800 may be provided below the tub 200. A drain pump 900 may also be provided below the tub 200.

Figure 2:
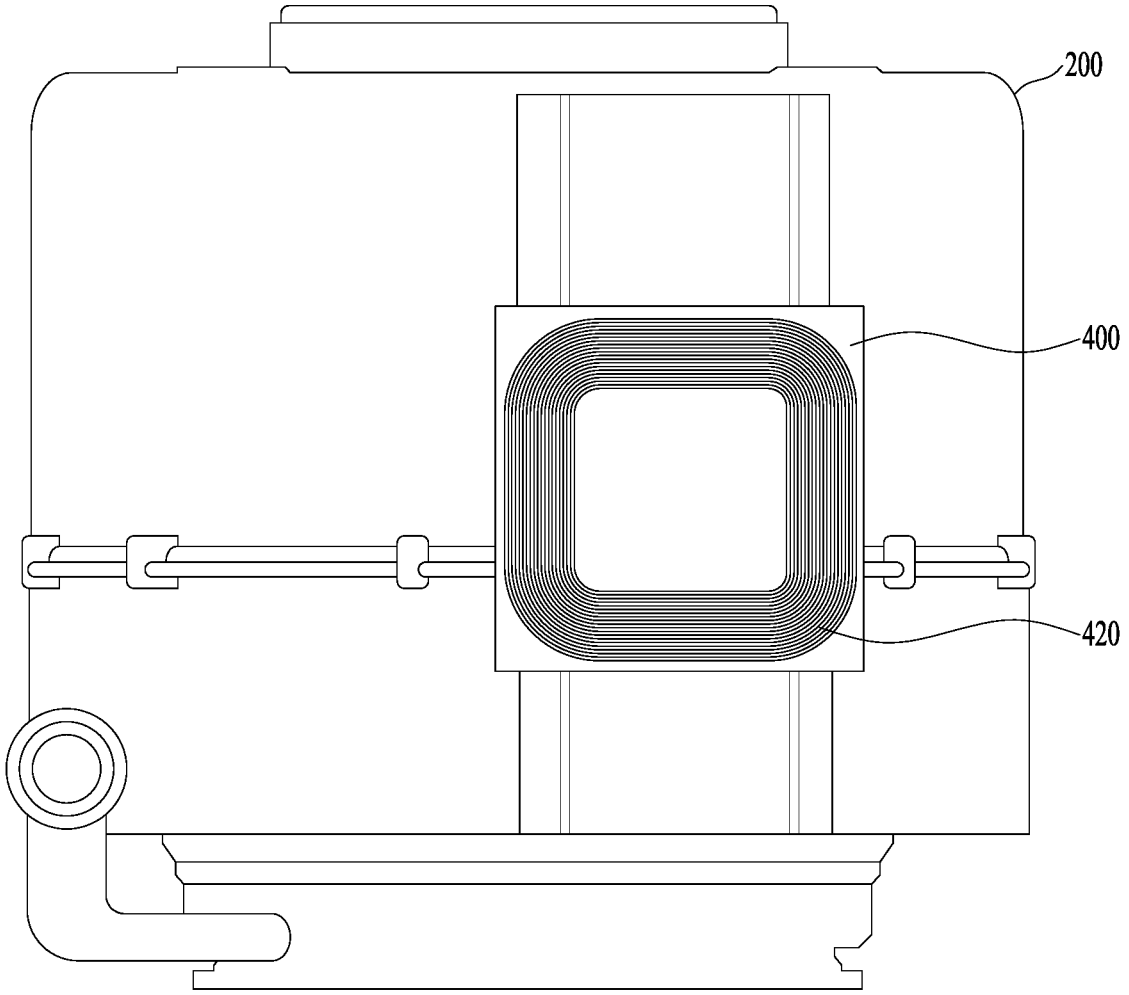
FIG. 2 illustrates an induction module mounted on a tub in the laundry treatment apparatus according to an embodiment of the present invention.

As illustrated in FIGS. 1 and 2, the induction module 400 may be elongated in the longitudinal direction of the tub 200 and may be mounted on the outer peripheral surface of the tub 200. The induction module 400 may be mounted on the outer peripheral surface of an upper portion of the tub 200. This is because there may be insufficient space to install the induction module 400 due to the above-described constituent elements, such as the support device 800 and the drain pump 900, on the outer peripheral surface of a lower portion of the tub 200.

The induction module 400 may face a portion of the outer peripheral surface of the drum 300, which is in the stopped state. Thus, when current is applied to the induction module 400, only a portion of the outer peripheral surface of the drum 300 may be substantially heated. However, when the drum 300 rotates while the induction module 400 operates, the entire outer peripheral surface of the drum 300 may be uniformly heated.

In consideration of the heating efficiency of the induction module 400, the foremost and the rearmost portion of the drum 300 may not be heated. This is because laundry may be substantially gathered and processed at the central portion of the drum 300 in the longitudinal direction. The heated drum 300 needs to transfer heat to the laundry inside the drum 300, but may have difficulty in transferring heat to the laundry from the foremost and rearmost portions thereof. Thus, heating these foremost and rearmost portions may cause deterioration in heating efficiency.

Therefore, the induction module 400 may be mounted on the longitudinal center portion of the tub 20 so as to extend in the longitudinal direction.

A lifter 50 may be mounted inside the drum 300 to agitate the laundry inside the drum 300. The lifter 50 may function to lift the laundry when the drum 300 rotates. The laundry lifted by the lifter 50 falls. Thus, the lifter 50 may enhance washing performance or drying performance. The lifter 50 may be generally necessary for a drum type laundry treatment apparatus.

The lifter 50 is different from embossments on the drum 300. That is, the length of the lifter 50 that protrudes into the drum 300 is much larger than that of the embossments. In addition, unlike the embossments, the lifter extends in the longitudinal direction of the drum 300.

As illustrated in FIG. 1, the lifter 50 is mounted on the longitudinal central portion of the drum 300 so as to extend in the longitudinal direction. In addition, a plurality of lifters 50 may be provided in the circumferential direction of the drum 300. As illustrated, the position of the lifter 50 is similar to the position at which the induction module 400 is mounted. That is, a large portion of the lifter 50 may be positioned to face the induction module 400. Thus, the outer peripheral surface of a portion the drum 300, in which the lifter 50 is provided, may be heated by the induction module 400. The outer peripheral surface of the portion of the drum 300, in which the lifter 50 is provided, is not in direct contact with the laundry inside the drum 300. The heat generated in the outer peripheral surface of the drum 300 is transferred to the lifter 50, rather than being transferred to the laundry, because the lifter 50 comes into contact with the laundry. Therefore, overheating of the lifter 50 may occur, which is problematic. Concretely, overheating of the drum circumferential surface that is in contact with the lifter 50 may be problematic.

Figure 3:
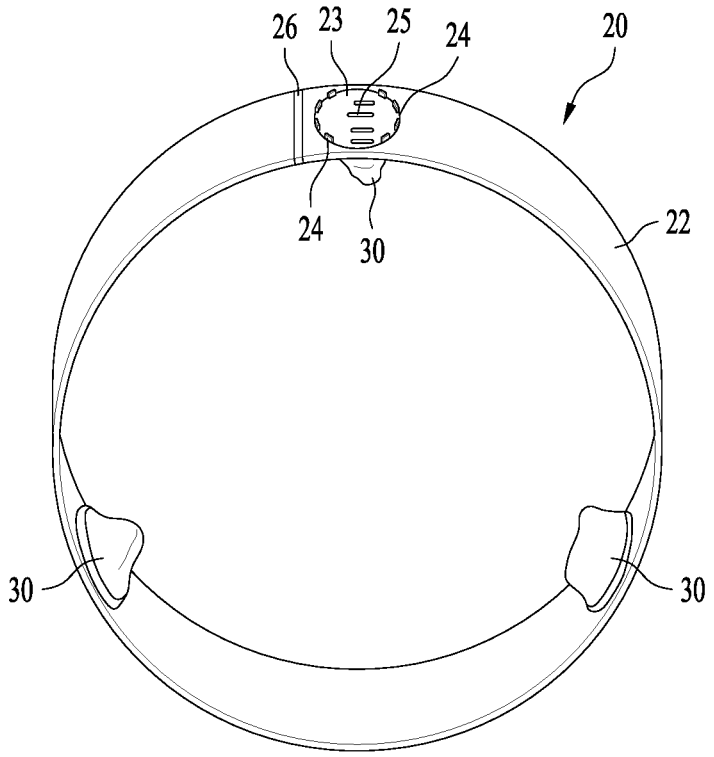
FIG. 3 illustrates a lifter mounted on a general drum.

FIG. 3 illustrates a lifter 30 mounted on a general drum 20. Only the drum center portion is illustrated, and front and rear portions of the drum 20 are omitted. This is because the lifter 30 may generally be mounted only on the drum center.

A plurality of lifters 30 are mounted in the circumferential direction of the drum 20. Here, three lifters 30 are mounted by way of example.

The circumferential surface of the drum 20 may be composed of a lifter mounting portion 23 in which the lifter 30 is mounted and a lifter exclusion portion 22 in which no lifter is mounted. The cylindrical drum 20 may be formed to have a seam portion 26 by rolling a metal plate. The seam portion 26 may be a portion at which both ends of the metal plate are connected to each other through welding or the like.

Various embossing patterns may be formed on the circumferential surface of the drum 20, and a plurality of through-holes 24 and lifter communication holes 25 may be formed for the mounting of the lifters 30. That is, various embossing patterns may be formed in the lifter exclusion portion 22, and the plurality of through-holes 24 and lifter communication holes 25 may be formed in the lifter mounting portion 23.

The lifter mounting portion 23 is a portion of the circumferential surface of the drum 20. Thus, in general, the lifter mounting portion 23 is formed with only a minimum number of holes for the mounting of the lifters and the passage of wash water. This is because, when a greater number of holes are formed through penetration or the like, manufacturing costs may unnecessarily increase.

Accordingly, the plurality of through-holes 24 may be formed in the lifter mounting portion 23 along the outer shape of the lifter 30 to be mounted, so that the lifter 30 may be coupled to the inner peripheral surface of the drum 20 via the through-holes 24. In addition, the plurality of lifter communication holes 25 may be formed in the central portion of the lifter mounting portion 23 so as to allow wash water to move from the outside of the drum 20 to the inside of the lifter 30.

However, it is general that only the necessary holes 24 and 25 are formed in the lifter mounting portion 23, and a large portion of the outer peripheral surface of the drum 20 is maintained as it is. That is, the total area of the holes 24 and 25 is smaller than the total area of the lifter mounting portion 23. Thus, a large area of the lifter mounting portion 23 excluding the area of the holes may directly face the induction module 400, and the lifter mounting portion 23 may be heated by the induction module 400.

The lifter 30 is mounted in the lifter mounting portion 23 so as to protrude inwards in the radial direction of the drum 20. As such, the lifter mounting portion 23 does not contact with the laundry inside the drum 20, and the lifter 30 comes into contact with the drum 20.

The lifter 30 may be generally formed of a plastic material. Since the plastic lifter 30 comes into direct contact with the lifter mounting portion 23, the heat generated in the lifter mounting portion 23 may be transferred to the lifter 30. However, the lifter 30 formed of a plastic material may transfer a very small amount of heat to the laundry that comes into contact with the lifter 30. This is because the plastic material of the lifter 30 has a very low heat transfer characteristic. Therefore, only a portion of the lifter 30 that is in contact with the lifter mounting portion 23 is exposed to a high temperature, and the heat is not transmitted to the entire lifter 30.

According to the results of experimentation performed by the inventors of the present invention, it could be found that the temperature at the lifter mounting portion may rise to 160 degrees Celsius, while the temperature at the portion in which no lifter is mounted may rise to 140 degrees Celsius. It may be considered that this is because the heat generated in the lifter mounting portion may not be transferred to the laundry.

Therefore, the lifter 30 may overheat, which may cause damage to the lifter 30. In addition, since the heat generated in the lifter mounting portion 23 may not be transferred to the laundry, energy may be wasted and heating efficiency may be lowered. The embodiments of the present invention are devised to overcome these problems.

Figure 4:
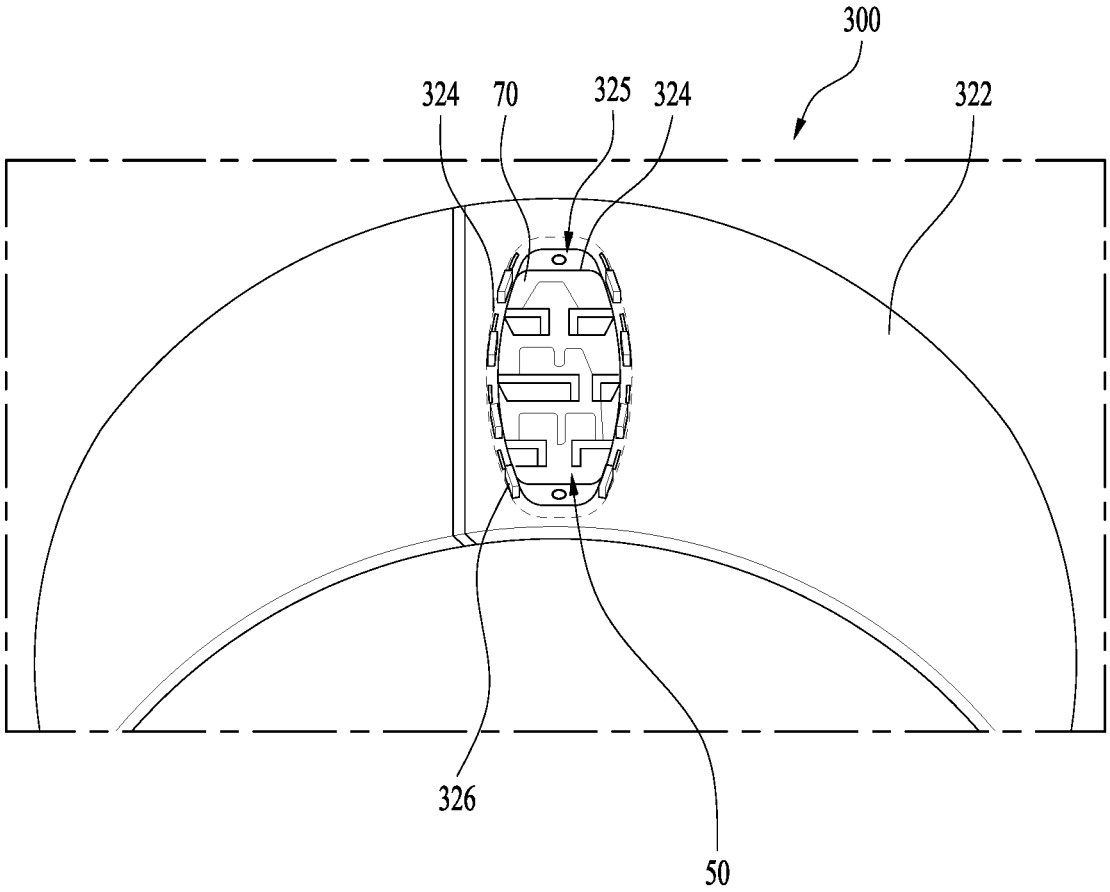
FIG. 4 illustrates the connected state of a drum and a lifter according to an embodiment of the present invention.

FIG. 4 illustrates a drum and a lifter according to an embodiment of the present invention. The manufacturing method or shape of the drum may be the same as or similar to that of the general drum illustrated in FIG. 3. However, it is to be noted that a lifter mounting portion 323 may be different and that the material and shape of the lifter may be changed.

As illustrated, a lifter exclusion portion 322 may be the same as that of the general drum described above. In the lifter mounting portion 323, unlike the lifter exclusion portion 322, the circumferential surface of the drum may be omitted or removed. That is, an area equivalent to the area of the lifter may be omitted or removed from the circumferential surface of the drum. An area larger than the omission area due to the holes for the mounting of the lifter or the passage of wash water described above may be omitted.

Figure 7:
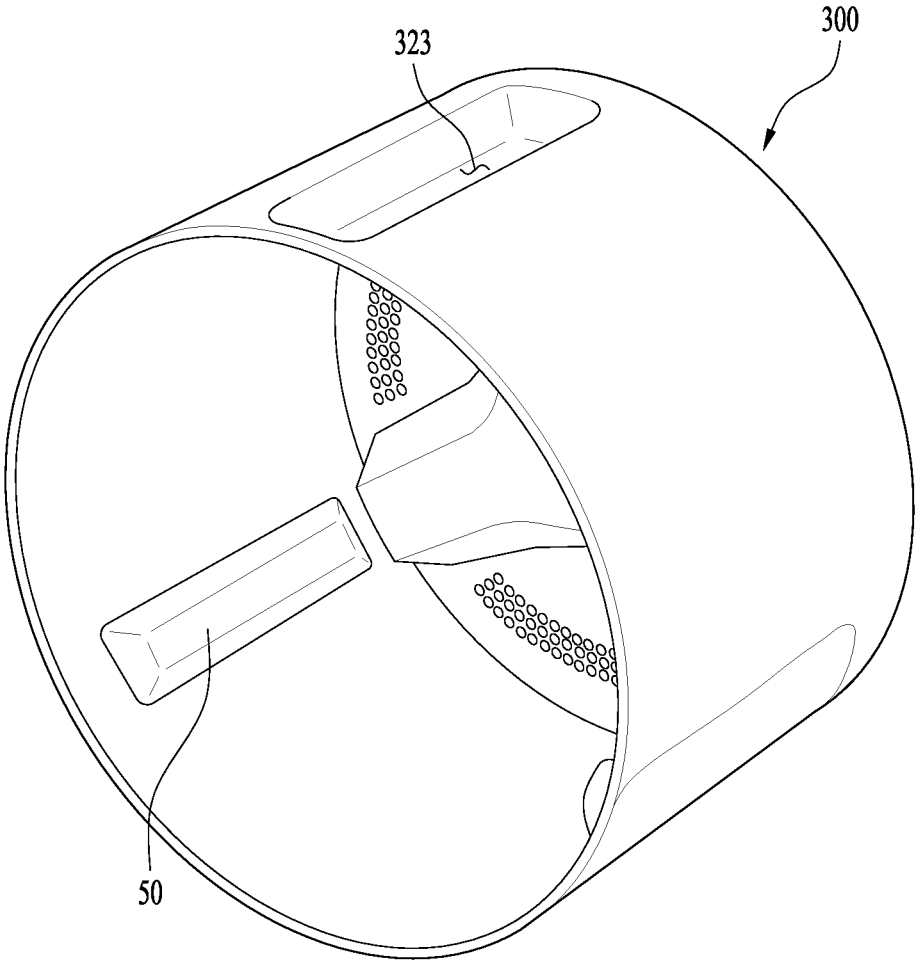
FIG. 7 illustrates the configuration of a drum according to an embodiment of the present invention.

Concretely, a recessed region 325 may be formed in the central portion of the lifter mounting portion 323. The recessed region 325 may take the form of an incision formed by cutting away a portion of the circumferential surface of the drum, or may take the form of a recess that is centrally recessed in a portion of the circumferential surface of the drum. FIG. 4 illustrates the former embodiment, and FIG. 7 illustrates the latter embodiment.

A plurality of through-holes 324 and 326 may be formed in the lifter mounting portion 323 to correspond to the shape of the lifter 50 to be mounted. The plurality of through-holes 324 and 326 may be formed along the outer rim (frame) of the lifter 50 so as to correspond to the outer contour of the lifter 50. For example, when the lifter is in the form of a track, the through-holes may be formed along the outer rim of the track. Of course, these through-holes may be formed in the form of drilled holes in a portion of the circumferential surface of the drum.

A portion of the circumferential surface of the drum that corresponds to the central portion of the lifter mounting portion 323 may be omitted. That is, the area that faces the induction module 400 may be omitted. That is, the portion surrounded by the through-holes 324 and 326 may be wholly cut away to form the recessed region 325 in the form of an incision.

The recessed region 325 is formed to correspond to the inside of the lifter 50 and is surrounded by the lifter 50. Thus, the recessed region in the form of an incision is not visible inside the drum. The central portion of the lifter 50 mounted in the lifter mounting portion 323 is visible from outside the drum.

With the lifter mounting portion 323, the circumferential surface of the drum may substantially not face the induction module 400 in a portion thereof in which the lifter 50 is mounted. Thus, the amount of heat generated in the lifter mounting portion 323 is very small. This means that a common plastic lifter may be used. This is because the amount of heat generated in the entire lifter mounting portion 323 is very small, so that the lifter 50 may not be overheated by heat transferred to the lifter 50.

However, when a general plastic lifter is used, local heating may occur at a portion in which the lifter 50 and the lifter mounting portion 323 are coupled to each other, which may cause damage to a local portion of the lifter 50. In addition, although the amount of heat, generated when the lifter mounting portion 323 faces the induction module, is minimal, the induction module is being driven, and therefore, energy loss may occur because most of the energy used is not converted into thermal energy.

Therefore, it is necessary to seek a method to satisfy both the prevention of overheating of the lifter and the minimization of energy loss occurring in the lifter mounting portion.

Figure 5:
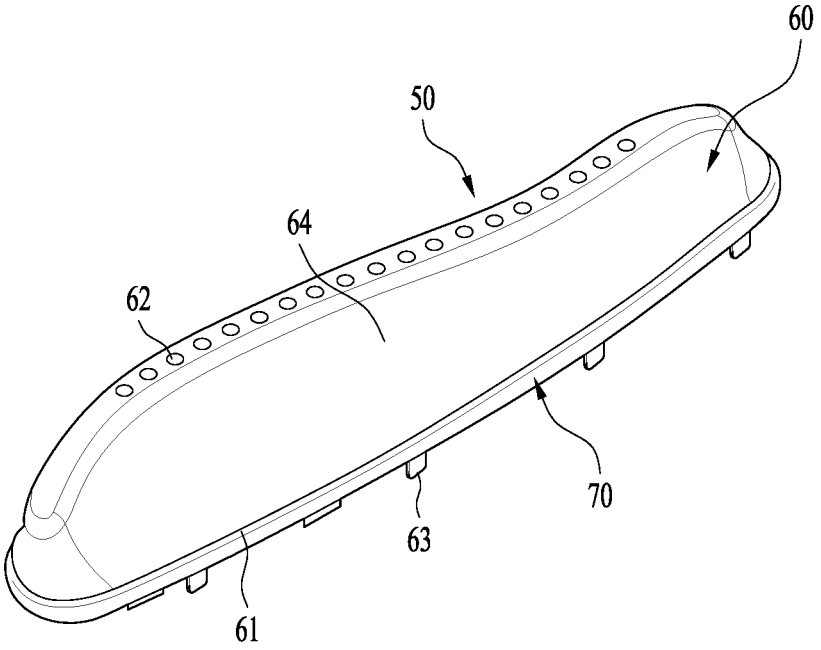
FIG. 5 illustrates the lifter illustrated in FIG. 4.

A lifter that is applicable to an embodiment of the present invention will be described in detail with reference to FIGS. 5 and 6. According to the present embodiment, damage to the lifter due to overheating and energy loss may be reduced.

The lifter 50 according to the present embodiment may include an inner lifter 60 formed of a metal. The inner lifter 60 may be formed to have an elliptical shape or a track shape. That is, the shape of the outer rim or the frame 61 that abuts the inner peripheral surface of the drum may be an elliptical shape or a track shape. Of course, the shape of the inner lifter 60 may be modified to some extent. However, the inner lifter 60 may have a shape in which the length is larger than the width so as to be elongated in the longitudinal direction of the drum when it is mounted on the drum.

The inner lifter 60 may be recessed from the outer rim 61 thereof. That is, the inner lifter 60 may be recessed toward the center of the drum. More specifically, the recessed shape of the inner lifter 60 forms the outer shape of the lifter 50 inside the drum. That is, since the inner lifter 60 is recessed, the lifter 50 may protrude toward the center of the drum.

The inner lifter 60 may be formed of a metal material, and may have a larger distance to the induction module 400 compared to the lifter 50 because a portion of the inner lifter 60 inside the outer rim 61 is recessed. As described above, a portion of the circumferential surface of the drum that corresponds to the inner lifter 60 has been removed. Thus, it can be said that the removed circumferential surface is replaced with the inner lifter 60. In other words, it can be said that the removed circumferential surface takes the form of the inner lifter 60 and is moved in the direction in which the distance to the induction module facing thereto increases. That is, the surface of the inner lifter 60 that faces the induction module is moved further inwards in the radial direction of the drum than the surface of the lifter exclusion portion that faces the induction module.

However, the maximum depth or the maximum protruding length of the inner lifter 60 is small compared to the radius of the drum from the inner peripheral surface to the center of the drum. That is, the increase in the distance between the inner lifter 60 and the induction module is relatively small.

The inner lifter 60 may be recessed so as to be curved or inclined in the radial direction. That is, the inner lifter 60 may be recessed so as to have an inclined surface, rather than being recessed at a right angle from the outer periphery 61 to the center of the inner lifter 60. As such, the inner lifter 60 has an induction module projection surface 64 that faces the induction module 400 and has substantially the same area as the area inside the outer rim 61 of the inner lifter 60. However, due to a change in the contour line depending on the recessed shape, i.e., an increase in the recess depth or the protruding length, the distance between the inner lifter 60 and the induction module 400 that face each other is variable according to the position on the surface of the inner lifter 60 that faces the induction module 400. That is, the distance may become the minimum at the outer rim 61, and may become the maximum at the central portion of the inner lifter 60.

Here, it can be seen that the inner lifter 60 may be differently heated by the induction module 400 according to the material of the inner lifter 60 and the height of the inner lifter 60. Since the inner lifter 60 may take the form of a thin metal plate, the inner lifter 60 may also be effectively heated by the induction module 400. Of course, the inner lifter 60 is recessed from the inner peripheral surface of the drum so that the distance to the induction module that faces the inner lifter 60 is increased, but this increase in distance is relatively small, and thus the inner lifter 60 may be sufficiently heated.

The inner lifter 60 is an element that is in direct contact with the laundry. Thus, the heat generated in the inner lifter 60 may be directly transferred to the laundry. Therefore, the inner lifter 60 may transfer the energy used in the induction module 400 to the laundry, thereby improving the heating efficiency.

A through-hole 62 may be formed in the central portion of the inner lifter 60. That is, the wash water may be introduced into the drum from the inside of the inner lifter 60. Since a water stream is formed through the lifter communication hole 62, the efficiency of washing may be increased.

A plurality of coupling ribs 63 may be formed on the outer rim 61 or a drum coupling surface of the inner lifter 60. The plurality of coupling ribs 63 may be arranged along the outer rim 61.

The coupling ribs 63 may be inserted into the through-holes 324 and 326 formed in the lifter mounting portion 323, as illustrated in FIG. 4. Specifically, the coupling rib 63 may be coupled into the rib through-hole 326. In order to reduce the contact area with the drum, the coupling rib 63 may take the form of a rib having a thickness smaller than the width, and the through-hole, more particularly, the rib through-hole 326, into which the coupling rib 63 is inserted, may have a slit shape.

The heat generated in the circumferential surface of the drum in the vicinity of the rib through-hole 326 may be transferred to the inner lifter 60 through the coupling rib 63. This may increase energy efficiency.

Specifically, through the provision of the recess or the incision, a portion of the circumferential surface of the drum that corresponds to the lifter mounting portion 323 may be omitted, and thus it may be unnecessary to heat the corresponding portion. This is because heat generated in this portion is difficult to be transferred to the laundry.

Meanwhile, through the provision of the recess or the incision, the metal surface of the lifter may face the induction module and be heated to directly transfer heat to the laundry. That is, through the provision of the lifter that is recessed in the direction in which the distance to the induction module that faces the lifter is increased, it is possible to prevent overheating of the lifter and to enable the utilization of the heat of the lifter. In particular, the inner lifter may be formed of a metal material, more preferably, the same material as the drum, for example, stainless steel, so that the inner lifter may be formed as if it were a portion of the circumferential surface of the drum that protrudes into the drum.

In this way, an increase in energy efficiency and heating effect may be achieved.

Figure 6:
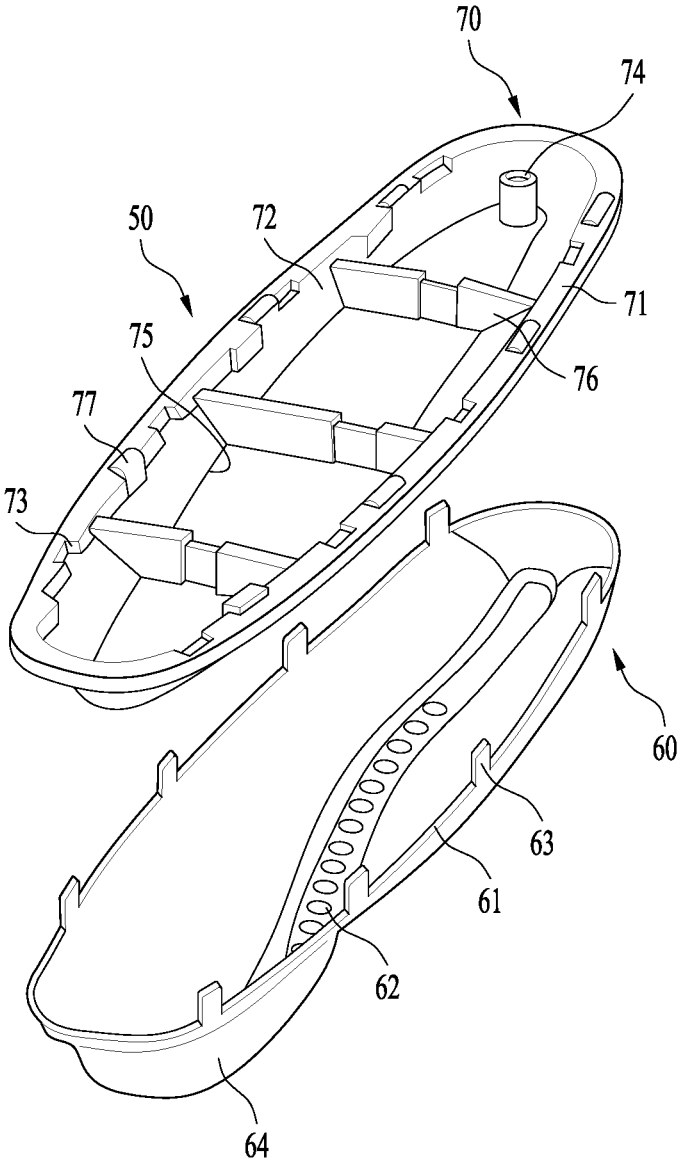
FIG. 6 illustrates an exploded state of the lifter illustrated in FIG. 5.

As illustrated in FIG. 6, the lifter 50 may further include an outer lifter 70. The outer lifter 70 may be coupled to the inner lifter 60. An empty space may be formed in the lifter 50 by the coupling of the two.

In the case in which only the inner lifter 60 is provided, the inner lifter 60 may not be firmly coupled to the drum because it is necessary to minimize the portion of the inner lifter 60 that is in contact with the drum. In addition, the rigidity of the inner lifter 60 may be deteriorated due to the small thickness of the inner lifter 60. That is, the inner lifter 60 may be easily collapsed by an external impact.

In order to overcome this problem, the lifter 50 may further include the outer lifter 70 formed of a plastic material. Through the provision of the outer lifter 70, the lifter 50 may be more firmly coupled to the drum.

Here, it may be necessary for the outer lifter 70 to be in contact with the drum. That is, even if the contact area is minimized, the contact area may be required for coupling between the outer lifter 70 and the drum. Therefore, the outer lifter 70 may be formed of an engineering plastic material having excellent heat resistance. An empty space may be formed between the outer lifter 70 and the inner lifter 60, and the inner lifter 60 may substantially form only the bottom surface of the lifter 50. That is, an outer area of the lifter 50 occupied by the inner lifter 60 is relatively small. Therefore, it is more economical to form the outer lifter 70 using an engineering plastic material than to form the entire lifter 50 using an engineering plastic material. In addition, since the inner lifter 60 is formed of a metal material, heat may be effectively transferred to the laundry.

Therefore, it may be highly desirable to construct the lifter 50 by combining the inner lifter 60, formed of a metal material, and the outer lifter 70 formed of an engineering plastic material.

To this end, the outer lifter 70 has a bottom surface or an outer rim 71 that defines the bottom surface of the entire lifter 50. However, in order to reduce the contact area with the drum, the outer rim 71 is formed to be narrow. That is, the outer rim 71 may be formed to have a hollow elliptical shape or track shape. The outer rim 71 may also be referred to as a frame of the outer lifter 70.

A through-hole or an insertion hole 73, through which the coupling rib 63 of the inner lifter 60 passes, may be formed in the outer rim 71 of the outer lifter 70. The coupling rib 63 may first pass through the through-hole 73 and may then be connected to the drum. Thereby, the heat generated from the outer peripheral surface of the drum, which is in contact with the outer lifter 70, may be more effectively transferred to the coupling rib 63, formed of a metal material, than to the outer rim 71 of the outer lifter 70 formed of a plastic material.

A hook 77 may be provided to more firmly couple the lifter 50, more particularly, the outer lifter 70, to the drum. The hook 77 may be formed on the outer rim 71 or the frame of the outer lifter 70. Of course, a through-hole may be formed in the lifter mounting portion of the drum so that the hook is inserted into and fixed to the through-hole.

Meanwhile, a portion of the outer lifter 70 excluding the outer rim 71 may be inserted into the inner lifter 60. This may increase the rigidity of the inner lifter 60.

A portion of the outer lifter 70 inside the frame 71 that is to be inserted into the inner lifter, i.e. an insertion portion 72, may be formed with various elements. The insertion portion 72 may not come into contact with the inner peripheral surface of the drum. That is, only the outer rim 71, but not the insertion portion 72, may be in contact with the inner peripheral surface of the drum. Thus, the outer rim 71 may also be referred to as a contact portion for distinguishing the insertion portion 72 from the outer rim 71.

A reinforcement rib 76 may be formed on the insertion portion 72 in the width direction for reinforcing the rigidity of the outer lifter 70. A plurality of reinforcement ribs 76 may be formed to extend in the width direction of the outer lifter 70 so as to interconnect opposite portions of the frame 71. The width direction of the outer lifter 70 is the same as the direction in which external force is applied to the lifter 50. That is, the width direction of the outer lifter 70 coincides with the direction in which the lifter 50 comes into contact with the laundry and lifts the laundry. Therefore, the reinforcement ribs 76 may be formed in the width direction, rather than in the longitudinal direction, of the lifter 50.

In addition, a boss 74 may be formed to further firmly couple the outer lifter 70 to the drum, and a screw fastening hole may be formed in the boss. A screw through-hole may be formed in the drum so as to correspond to the screw fastening hole.

In addition, the outer lifter 70 may be formed with a penetration region 75. The penetration region 75 may be formed to introduce wash water into the lifter 50 from the outside of the drum 30. The penetration region 75 may be formed in a plural number. The area of the penetration region 75 may be greater than the area of the through-hole 62 in the lifter 50. As such, stronger water flow may be formed through the through-hole 62 by the pressure difference between the outside and the inside of the lifter 50.

Meanwhile, the frame 71 of the outer lifter 70 is directly in contact with the inner peripheral surface of the drum. As described above, the width of the frame 71 is relatively small in order to reduce the contact area with the drum. The inside of the frame 71 is empty, and an empty space is also formed in the circumferential surface of the drum so as to correspond to the empty space. That is, an incision or a recess is formed. The incision or the recess may be substantially equal to the inner area of the frame 71. That is, substantially the entire circumferential surface of the drum inside the frame 71 may be removed. Thus, as illustrated in FIG. 4, as large a portion as possible of the circumferential surface of the drum inside the frame 71 may be removed, and the resulting region may be referred to as an incision, a recess, or a drum communication region 325.

FIG. 4 illustrates that one drum communication region 325 having a shape corresponding to the shape of the lifter 50 is formed. This is because it may be desirable to remove as much of the area of the drum circumferential surface as possible so as to correspond to the shape of the lifter 50. However, the drum communication region 325 may be divided into a plurality of regions. That is, the large drum communication region 325 may be divided into a plurality of small regions. However, since a portion of the drum circumference needs to be left in order to divide the drum communication region 325 into a plurality of regions, heating of this portion may cause energy loss.

Hereinafter, a drum according to an embodiment of the present invention will be described with reference to FIG. 7.

In the above-described embodiment, the lifter, which comes into contact with the laundry inside the drum, is manufactured separately from the drum and mounted in the drum. In particular, the surface of the lifter that faces the drum and comes into contact with the drum is formed of a metal material, and an empty space is formed between the surface of the lifter and the induction module. As such, the surface of the lifter that faces the drum may be formed by recessing a portion of the circumferential surface of the drum, in which the lifter is mounted, toward the rotation center axis of the drum.

In the present embodiment, the lifter may be integrally formed on the drum, rather than being manufactured separately from the drum and being mounted in the drum.

That is, the lifter 50 may be formed by recessing a portion of the circumferential surface of the drum toward the center of the drum. When viewed from the inside of the drum, the lifter 50 is formed in a manner such that a portion of the drum is recessed inwards. When viewed from the outside of the drum, the recessed region 325 having an empty space is formed in a manner such that a portion of the outer peripheral surface of the drum is recessed. This empty space is filled with air. As such, the surface of the lifter 50 that faces the drum is moved toward the center of the drum. The surface of the lifter that faces the drum is formed so as to be further increased in the distance to the induction module.

Accordingly, the surface of the lifter that faces the drum is heated by the induction module and the lifter 50 comes into contact with the laundry, so that heat may be easily transferred to the laundry. Thus, the energy used in the induction module is converted into thermal energy in the entire drum, more particularly in the lifter, and the heat may be effectively transferred from the inner peripheral surface of the drum including the lifter to the laundry.

In this way, in all of the embodiments described above, it is possible to prevent damage to the lifter and deterioration in energy efficiency, which may occur in the case in which the lifter is formed of a plastic material. In addition, since the heat may be effectively transferred to the laundry even from the lifter, the heating performance may be further enhanced. For example, when drying the laundry by applying heat to the laundry, the drying performance may be further enhanced.

In the above-described embodiments, the detailed structure of the general drum or the detailed structure of the lifter may be changed to overcome any problem that may be caused by the lifter.

A provider who provides the laundry treatment apparatus may provide various types of laundry treatment apparatus as well as a specific type of laundry treatment apparatus. For example, the provider may provide both a washing machine having no drying function and a washing machine having a drying function. Therefore, in the case of models having the same capacity, it is economical to produce the same devices using common components.

For example, in the case of a washing machine and a washing and drying machine having the same capacity (washing capacity), it may be more economical for a manufacturer to use the same drum and the same lifter in common for various models. Using the existing drum and lifter in a new model without modification may be advantageous in terms of product competitiveness. This is because, assuming mass production, changes in existing components may increase initial investment costs, maintenance costs, and production costs.

A method for overcoming the above-described problems may be sought while avoiding the problem of newly manufacturing a drum or a lifter. Hereinafter, other embodiments according to the present invention for overcoming the above-described problems will be described in detail.

Figure 8:
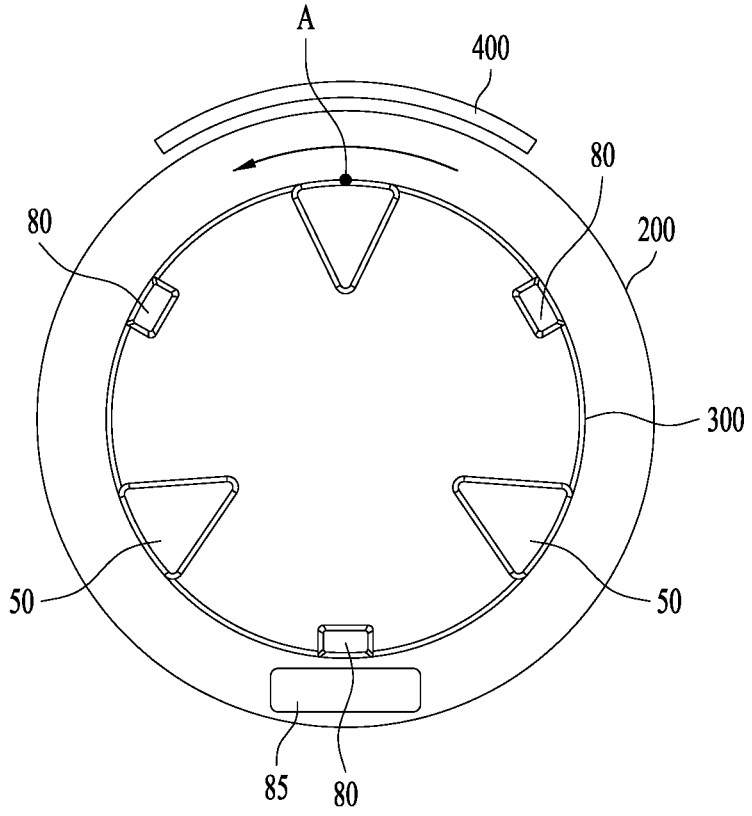
FIG. 8 schematically illustrates the configuration of a laundry treatment apparatus according to an embodiment of the present invention.

FIG. 8 is a simplified conceptual diagram of components according to an embodiment of the present invention.

As illustrated in FIG. 8, in the present embodiment, similarly, the drum 300 is heated via the induction module 400. In addition, similarly, the lifter 50 is mounted inside the drum 300. In addition, the induction module 400 may be mounted radially outside the drum 300, more specifically, on the outer peripheral surface of the tub 200, in the same manner as or similarly to the above-described embodiments.

The present embodiment has a feature in that current applied to the induction module 400 or the output of the induction module 400 may be varied when the rotation angle of the drum 300 is known. Specifically, since the drum 300 may be formed in a cylindrical shape, the rotation angle of the drum 300 may be defined as ranging from 0 degrees to 360 degrees about a specific point.

For example, the rotation angle of the drum at point A at which a specific lifter is at the uppermost portion may be defined as 0 degrees. Assuming that the drum rotates in the counterclockwise direction and that three lifters are equidistantly spaced apart from one another in the circumferential direction of the drum, it can be said that the lifters are located respectively at positions at which the rotation angle of the drum is 0 degree, at which the rotation angle of the drum is 120 degrees, and at which the rotation angle of the drum is 240 degrees. Considering the transverse width of the lifter, it can be said that the lifter is located in an angular range of approximately 2-10 degrees.

According to the present embodiment, it is possible to vary the amount of heating of the drum (hereinafter referred to as "drum heating amount") by the induction module 400 by grasping the position of the lifter 50 when the drum 300 rotates. That is, when the lifter 50 is located so as to face the induction module 400, the drum heating amount by the induction module may be reduced or eliminated, and when the lifter 50 is moved so as not to face the induction module 400, the drum heating amount may be normal. Changing the drum heating amount in this way may be realized by changing the output of the induction module 400.

Therefore, energy efficiency may be improved because the energy consumed in the induction module 400 is not consistent regardless of the rotation angle of the drum 300. In addition, since the energy consumed in the portion of the drum that corresponds to the lifter 50 may be significantly reduced, overheating in the lifter 50 may be remarkably reduced.

FIG. 8 illustrates magnets 80 that are equidistantly provided in the circumferential direction of the drum 300, in the same manner as the lifters 50. The magnets 80 may be provided to effectively grasp the rotation angle of the drum 300. Similarly to the lifters 50, the magnets 80 may be equidistantly disposed in the circumferential direction. In addition, the magnets 80 may be provided in the same number as the lifters 50. Of course, the angle between the lifter 50 and the magnet 80 may be consistent between the plurality of lifters 50 and the plurality of magnets 80.

Accordingly, when the position of a specific magnet 80 is sensed, the position of the lifter 50 associated with the specific magnet 80 may be sensed. Specifically, the positions of three lifters 50 may be sensed when the positions of three magnets 80 are sensed. When the magnet 80 is sensed at a specific position while the drum 300 rotates as illustrated in FIG. 8, it can be seen that the lifter 50 is located at a position at which the drum 300 rotates further by about 60 degrees in the counterclockwise direction.

Specifically, in the present embodiment, a sensor 85 may be further provided to sense the position of the lifter 50 by sensing the position of the magnet 80 when the drum 300 rotates. The sensor 85 may sense the position of the magnet 80 that corresponds to the rotation angle of the drum 300, and may sense the position of the lifter 50 based on the position of the magnet 80.

Of course, the sensor 85 may merely detect whether or not the magnet 80 is present. The rotational speed of the drum 300 may be constant at a specific point in time, and thus, it can be seen that the lifter 50 reaches a position at which it faces the induction module 400 when a specific time has passed from the point in time at which the magnet 80 is sensed.

To put it easily, assuming that the drum rotates at 1 RPM, it can be said that the drum rotates 360 degrees in 60 seconds. Assuming that three magnets 80 and three lifters 50 are disposed at the same angular distance, it can be seen that the lifter 50 reaches the position at which it faces the sensor 85 after the drum further rotates by 60 degrees, i.e. 10 seconds after the point in time at which the sensor 85 senses a specific magnet 80.

As illustrated in FIG. 8, it can be seen that any one lifter 50 is located to face the induction module 400 when the sensor 85 senses the magnet 80 located at the lowermost portion of the drum 300. Therefore, the drum heating amount by the induction module 400 may be reduced at the position at which the lifter 50 faces the induction module 400, and may be increased when the lifter 50 deviates from the position. For example, the output of the induction module 400 may be interrupted, or the output of the induction module 400 may be maintained at a normal level.

The magnet 80 may be disposed at the same position as the lifter 50, regardless of what is illustrated in FIG. 8. In this case, sensing the position of the magnet 80 may be the same as sensing the position of the lifter 50. However, in this case, it may be difficult to drive the induction module 400, which is of chief importance. Although it is possible to vary the output of the induction module 400 within a very short time, it is not easy to vary the output of the induction module 400 simultaneously with sensing of the magnet 80. This is because the angular area occupied by the lifter 50 may be greater than the angular area occupied by the magnet 80. The position of the magnet 80 may be defined by a specific angle, but the angle of the lifter 50 may be defined by a specific angular range, rather than a specific angle.

Therefore, in consideration of a time required to change the output and the angular area occupied by the lifter 50, the position of the magnet 80 may be circumferentially spaced apart from the lifter 50 by a predetermined angle in order to more accurately vary the output of the induction module 400. In addition, the acceptable delay time may change based on the drum RPM.

It is necessary for the magnet 80 to rotate together with the drum 300. Therefore, the magnet 80 may be provided on the drum 300. In addition, the sensor 85 for sensing the magnet 80 may be provided on the tub 200. That is, in the same manner as the manner in which the drum 300 rotates relative to the fixed tub 200, the magnet 80 may rotate relative to the fixed sensor 85.

Figure 9:
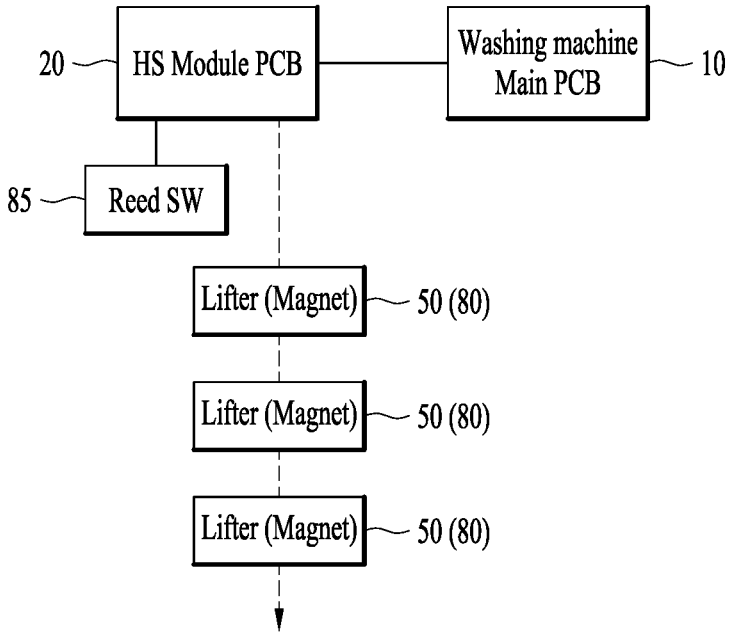
FIG. 9 illustrates a block diagram of control elements that are applicable to FIG. 8.

FIG. 9 illustrates control elements for grasping the position of the lifter 50 by sensing the position of the magnet 80.

A main controller 10 or a main processor of the laundry treatment apparatus controls various operations of the laundry treatment apparatus. For example, the main controller 10 controls whether or not to drive the drum 300 and the rotational speed of the drum. In addition, a module controller 20 may be provided to control the output of the induction module under the control of the main controller 10. The module controller may also be referred to as an induction heater (IH) controller or an induction system (IS) controller.

The module controller 20 may control the current applied to an induction drive unit, or may control the output of the induction module. For example, when the controller 10 issues a command to operate the induction module to the module controller 20, the module controller 20 may perform control so that the induction module operates. When the induction module is configured to be simply repeatedly turned on and off, a separate module controller 20 may not be required. For example, the induction module may be controlled so as to be turned on when the drum is driven and to be turned off when the drum stops.

However, in the present embodiment, the induction module may be controlled so as to be repeatedly turned on and off while the drum is being driven. That is, a point in time for control switching may very quickly change. Therefore, the module controller 20 may be provided to control the driving of the induction module, separately from the main controller 10. This also serves to reduce the burden of the processing capacity of the main controller 10.

The sensor 85 may be provided in various forms as long as it is capable of sensing the magnet 80 and transmitting the sensing result to the module controller 20.

The sensor 85 may be a reed switch. The reed switch is turned on when a magnetic force is applied by a magnet and is turned off when the magnetic force disappears. Thus, when the magnet is positioned as close as possible to the reed switch, the reed switch may be turned on due to the magnetic force of the magnet. Then, when the magnet becomes far away from the reed switch, the reed switch may be turned off. The reed switch outputs different signals or flags when turned on and off. For example, the reed switch may output a signal of 5V when turned on, and may output a signal of 0V when turned off. The module controller 20 may estimate the position of the lifter 50 by receiving these signals. Conversely, the reed switch may output a signal of 0V when turned on, and may output a signal of 0V when turned off. Since the period during which magnetic force is sensed is longer than the period during which no magnetic force is sensed, the reed switch may be configured to output a signal of 0V when detecting the magnetic force.

The module controller 20 may acquire information on the drum RPM via the main controller 10. Then, the module controller 20 may grasp the angle between the lifter 50 and the magnet 80. Thus, the module controller 20 may estimate the position of the lifter 50 based on the signal of the reed switch 85. Of course, the module controller 20 may vary the output of the induction module based on the estimated position of the lifter 50. The module controller 20 may cause the output of the induction module to become zero or to be reduced at a position at which the lifter 50 faces the induction module. This may remarkably reduce unnecessary energy consumption in the portion in which the lifter 50 is mounted. Thereby, overheating in the portion in which the lifter 50 is mounted may be prevented.

The sensor 85 may be a hall sensor. The hall sensor may output different flags when sensing the magnet 80. For example, the sensor 85 may output Flag "0" when sensing the magnet 80, and may output Flag "1" when sensing no magnet.

In either case, the module controller 20 may estimate the position of the lifter 50 based on the magnet sensing signal. Then, the module controller 20 may variably control the output of the induction module based on the estimated position of the lifter 50.

On the other hand, the magnets may not be used in the same manner as the lifters. This is because the lifters may be disposed at the same interval from each other, and therefore, when the position of a specific lifter is detected, the positions of the other lifters may be estimated with high accuracy. That is, regardless of what is illustrated in FIG. 8, two of the three magnets may be omitted.

Generally, the main controller 10 of the washing machine is aware of the rotation angle of the drum and/or the rotation angle of the motor 700. Assuming that the motor 700 and the drum rotate integrally and that the rotation angle of the motor 700 is the same as the rotation angle of the drum, the positions of the three lifters may be grasped by grasping the position of one magnet.

For example, the drum may rotate at 1 RPM and the lifter may be located at a position at which the drum rotates by 60 degrees relative to one magnet. It can be seen that, when the sensor 85 senses the magnet 80, the lifter is located at the position to which the drum further rotates by 60 degrees (i.e., the position to which the drum further rotates in 10 seconds). Similarly, it can be seen that a second lifter is located at a position corresponding to a point in time at which 10 seconds have passed, and that a third lifter is located at a position corresponding to a point in time at which 10 seconds have passed.

That is, the main controller 10 may grasp the positions of the three lifters based on information on one magnet sensed by the sensor 85. Thus, the main controller 10 may control the module controller 20 to variably control the output of the induction module based on the positions of the lifters 50.

In this way, according to the embodiments described above, the output of the induction module may be reduced or set to zero at a point in time at which the lifter faces the induction module or for a time period during which the drum rotates, and the normal output of the induction module may be maintained when the lifter deviates from the position or the range at which it faces the induction module.

Therefore, unnecessary energy waste and overheating in the portion in which the lifter 50 is mounted may be prevented. Of course, since a conventional drum and lifter may be used without modification, it can be said that the present invention is very economically advantageous.

Figure 10:
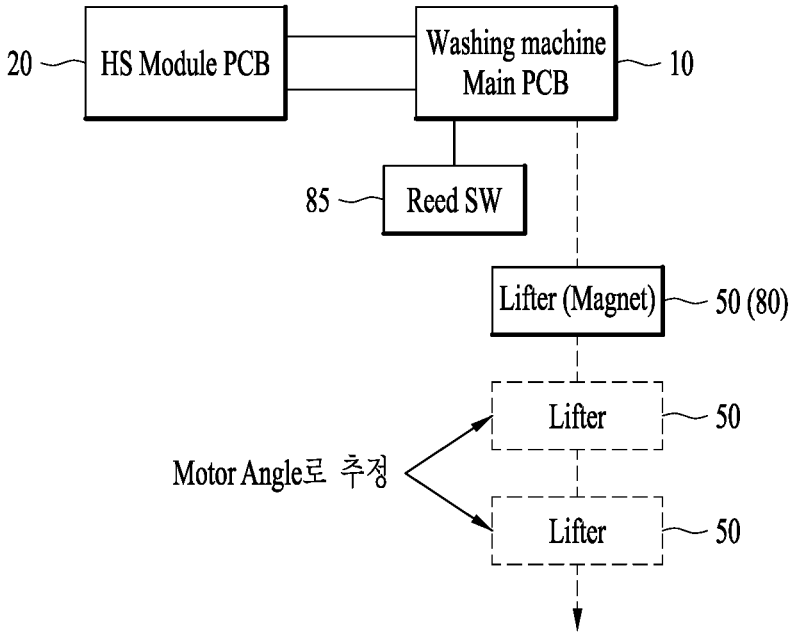
FIG. 10 illustrates a block diagram of another embodiment of the control elements.

It is to be noted that, in the embodiments described above with reference to FIGS. 8 to 10, a separate sensor and a separate magnet are necessary in order to grasp the positions of the lifters. Although the positions of the lifters may be grasped using any other type of sensor, the provision of a separate sensor for grasping the position of the lifter may be necessary in any case.

The separate sensor for grasping the position of the lifter may complicate the manufacture of the laundry treatment apparatus and may increase manufacturing costs. This is because a sensor or a magnet, which is unnecessary in a conventional laundry treatment apparatus, needs to be additionally provided. Moreover, the shape or structure of the tub or the drum also needs to be modified in order to accommodate such an additional component.

Hereinafter, embodiments that may achieve the above-described objects without requiring a separate sensor and a magnet will be described in detail.

Figure 11:
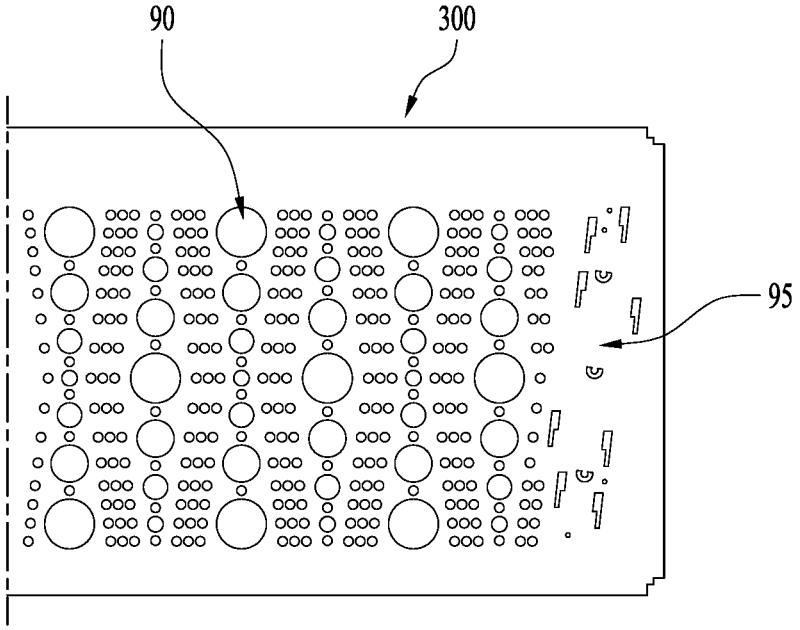
FIG. 11 illustrates an embodiment of the shape of the drum inner peripheral surface.

FIG. 11 illustrates a partial development view of the inner peripheral surface of the drum. As illustrated, various embossing patterns may be formed on the inner peripheral surface of the drum. These embossments may be formed in various forms, such as convex embossments that protrude in the inward direction of the drum and convex embossments that protrude in the outward direction of the drum. The shape of the embossments may be selected from any of various shapes. It is to be noted that the embossing patterns are generally equally and repeatedly repeated in the circumferential direction of the drum.

As with the embossments, through-holes are generally formed in the drum and serve to allow wash water to move between the inside and the outside of the drum.

The embossing patterns may be omitted in the portion of the circumferential surface of the drum in which the lifter is mounted. This is because the lifter may be easily mounted when the inner peripheral surface of the drum maintains a constant radius from the center of the drum. In other words, in the portion in which no lifter is mounted, the inner peripheral surface of the drum exhibits a great change in the radius thereof.

The embossments are formed such that a large portion thereof protrudes into the drum. That is, the area of the protruding portion is relatively large. This is because the area of the inner peripheral surface of the drum may increase due to the embossments that protrude into the drum, which may increase the frictional area between the laundry and the inner peripheral surface of the drum.

Assuming a drum having no embossments and having the same radius of the inner peripheral surface thereof, it can be said that the drum always faces the induction module with the same area and the same distance regardless of the rotation angle thereof.

However, the area and the distance by which the drum faces the induction module necessarily vary according to the rotation angle of the drum. The reason that the area and the distance by which the drum faces the induction module necessarily vary according to the rotation angle of the drum is due to the presence or absence of the embossing patterns or variation in the embossing patterns described above. That is, the shape of the drum that faces the induction module may inevitably vary.

Figure 12:
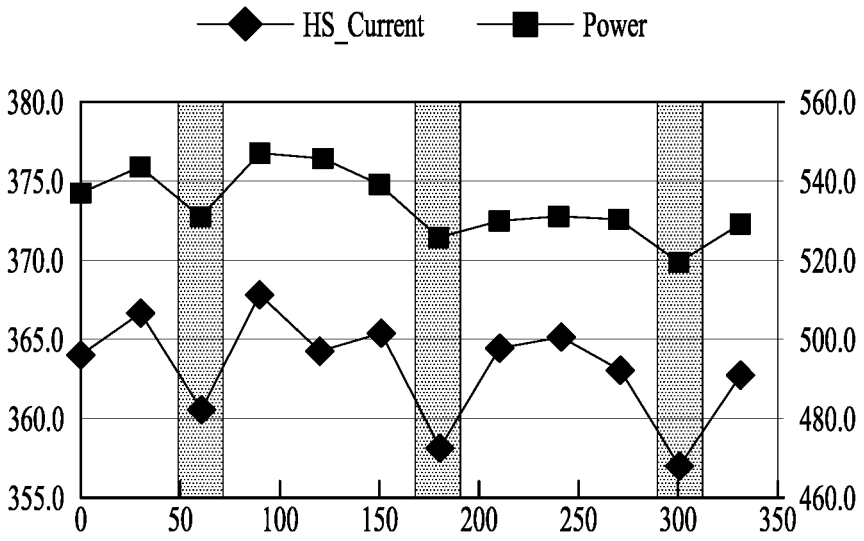
FIG. 12 illustrates a change in the current and output (power) of the induction module depending on the rotation angle of the drum with respect to the drum inner peripheral surface of FIG. 11.

FIG. 12 illustrates changes in the current and output of the induction module 400 depending on the rotational angle of the drum.

It can be seen that the current and the output of the induction module vary according to the rotation angle of the drum. In other words, it can be seen that the current and the output are greatly reduced at a specific point in time or at a specific angle.

The position of the lifter may be estimated without a separate sensor based on a change in the current sensed in the induction module or a change in the output of the induction module. For example, the current or output of the induction module may vary when the drum rotates while the induction module maintains a constant output.

In the state in which the induction module is controlled to have the same current or output via feedback control, the current or the output is reduced when the portion of the drum in which the lifter is mounted faces the induction module. This is because the area and the distance by which the drum faces the induction module may become the shortest at the corresponding portion. Therefore, the position of the lifter mounting portion may be estimated based on a change in the current or the output (power) of the induction module depending on a change in the rotation angle of the drum.

By estimating the position of the lifter mounting portion, the output (power) of the induction module at the lifter mounting position may be controlled to be 0, or may be significantly reduced.

Referring to FIG. 12, it can be estimated that the lifters are positioned respectively in the section of approximately 50-70 degrees, in the section of approximately 170-190 degrees, and in the section of approximately 290-310 degrees based on 360 degrees. For example, it can be estimated that the lifters are positioned in three angular sections while the induction module starts to drive and the drum rotates one revolution. Of course, in order to more accurately grasp the positions of the lifters, the positions of the lifters may be corrected by repeating the same process multiple times.

Then, when the estimation of the positions of the lifters is complete, the output of the induction module may be variably controlled based on the positions of the lifters during a subsequent drum rotation.

Through the embodiments described with reference to FIGS. 8 to 12, the heating efficiency may be enhanced and overheating of the lifter may be prevented without special modifications of the drum or the lifter.

Figure 13:
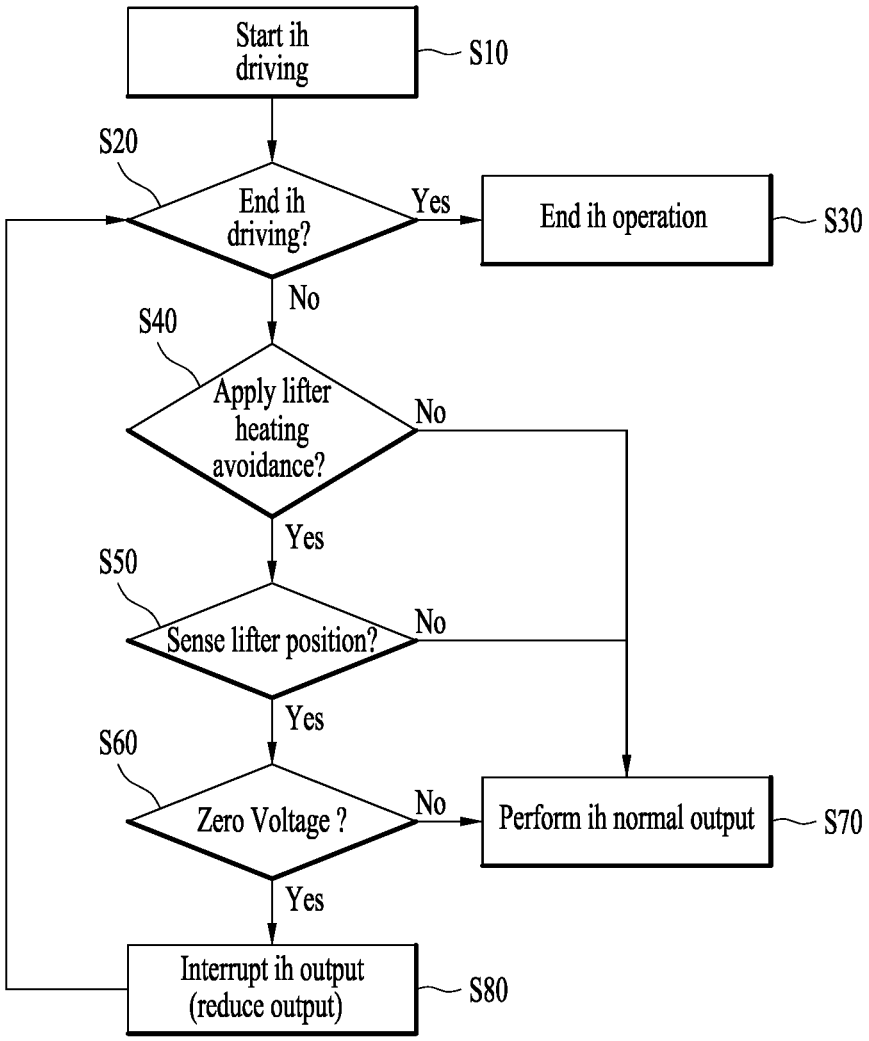
FIG. 13 illustrates a control flow according to an embodiment of the present invention.

Hereinafter, a control method according to an embodiment of the present invention will be described in detail with reference to FIG. 13. The present embodiment may be applied to the embodiments described above with reference to FIGS. 4 to 7 as well as the embodiments described above with reference to FIGS. 8 to 12. This is because overheating of the lifter mounting portion may be prevented via control of the induction module, in addition to prevention of overheating of the lifter mounting portion using a structural scheme.

First, driving of the induction module 400 starts (S10) in order to heat the drum as needed. This drum heating may be performed in order to dry the laundry inside the drum or to heat the wash water inside the tub. Thus, the induction module 400 may be driven when a drying operation or a washing operation is performed. The induction module 400 may also be driven during a dehydration operation. In this case, since the drum rotates at a very high speed, the drum heating amount may be relatively small, but the dehydration effect may be further enhanced since the removal of water by centrifugal force and the evaporation of water by heating are performed in a complex manner.

Once driving of the induction module 400 has started, it is determined whether or not an end condition is satisfied (S20). When the end condition is satisfied, the driving of the induction module 400 ends (S30). The end condition may be the end of the washing operation, or may be the end of the drying operation. However, the end of the driving S30 may be a temporary end, rather than a final end in one washing course or drying course. Thus, the induction module may be repeatedly turned on and off.

Once driving of the induction module 400 has started, the induction module 400 may be controlled to perform normal output until the driving of the induction module 400 ends (S30). That is, the induction module 400 may be controlled to have a predetermined output, and may be controlled via feedback for more accurate output control. Thus, the driving of the induction module 400 may include controlling the induction module to the normal output in by module controller.

In order to solve the overheating problem in the portion in which the lifter is mounted, the control method may include sensing the position of the lifter when the drum rotates (S50). Specifically, it may be determined whether or not the lifter is positioned so as to face the induction module (i.e. whether or not the lifter faces the induction module at the closest position). The sensing of the position of the lifter may be continuously performed while the drum is being driven. Of course, the induction module may not be continuously driven while the drum is being driven. For example, in a rinsing operation, the drum may be driven, but the induction module may not be driven. In addition, although the driving of the drum is continued in a washing operation, which is subsequently performed after the heating of wash water ends, the induction module may not be driven.

Therefore, the position of the lifter may be detected after the induction module is driven. That is, the detection of the position of the lifter may be performed under the assumption that driving of the induction module starts.

Once the position of the lifter has been detected, it may be determined whether or not the lifter is at a specific position. That is, it is determined whether the output is to be reduced or to be set to 0 (S60). When it is detected that the lifter is positioned to face the induction module, a condition under which the output is reduced or becomes zero is satisfied. Thus, the output of the induction is reduced or is set to 0 (S80). On the other hand, when it is detected that the lifter is not positioned to face the induction module, the induction module is maintained at the normal output (S70).

By repeating the steps described above, the output of the induction module may be controlled so as to be reduced when the lifter is positioned to face the induction module, and may be controlled to perform normal output when the lifter is not positioned to face the induction module. Thus, it is possible to prevent overheating of the lifter mounting portion and increase energy efficiency by a controllable method.

The control of the output of the induction module depending on the position of the lifter may not always be performed. That is, while the drum is driven and the induction module is driven, the output may be continuously maintained at a constant value regardless of the position of the lifter. That is, the control described above may be omitted when the risk of overheating of the lifter may be ignored.

To this end, it may be determined whether or not the sensing of the position of the lifter and the control of the output of the induction module are required in order to avoid overheating of the lifter (S40). This determination may be performed before sensing the position of the lifter.

For example, when the drum rotates at a high rotation speed, for example, 200 RPM or more, the drum heating amount generated in the lifter mounting portion is relatively small because of the high rotational speed of the drum. Of course, the drum rotation speed is so high that the area and time of contact between the drum and laundry are relatively large. This is because, in this case, the laundry is not moved by the lifter, but is in close contact with the inner peripheral surface of the drum.

That is, the control of the drum heating amount depending on the position of the lifter may be meaningless at a specific RPM or more at which the drum is spin-driven, rather than driven to perform tumbling.

Accordingly, the determination of whether or not to apply a lifter heating avoidance logic may be very effective. Of course, the conditions applied at this step may include various other conditions as well as the RPM. For example, when the drum is heated in a drying operation, a great amount of heat is transferred to the laundry. Thus, overheating may occur in a portion of the lifter that is not in contact with the laundry. On the other hand, when the drum is heated in the state in which wash water is accommodated in the tub and a portion of the outer peripheral surface of the drum is immersed in the wash water, heat is mostly transferred to the wash water. This may be true of the lifter exclusion portion as well as the lifter mounting portion.

Therefore, the condition for determining whether or not to apply the lifter heating avoidance logic may be a process of determining the type of an operation. The lifter heating avoidance logic may not be applied when a washing operation is determined. Thus, the conditions for applying the lifter heating avoidance logic may be variously modified.

Meanwhile, the sensing of the position of the lifter S50 may be performed in various ways. For example, the sensor and magnet described above may be used, or a change in the current or the output of the induction module may be used without a sensor.

Through the above-described embodiments, it is possible to prevent overheating of the lifter and to enhance energy efficiency. In addition, when the prevention of overheating of the lifter is not necessary, heating by the induction module may be utilized to the maximum extent.

As is apparent from the above description, according to an embodiment of the present invention, it is possible to provide a laundry treatment apparatus that effectively prevents overheating from occurring in a lifter provided in a drum, thereby enhancing safety and a method of controlling the same. In particular, it is possible to provide a laundry treatment apparatus that faithfully maintains the basic functions of a lifter and enhances stability and a method of controlling the same.

According to an embodiment of the present invention, it is possible to provide a laundry treatment apparatus that is capable of preventing overheating from occurring in a portion of a drum in which a lifter is mounted without changing the shapes of the drum and the lifter and a method of controlling the same.

According to an embodiment of the present invention, it is possible to provide a laundry treatment apparatus that is capable of grasping the position of a lifter and reducing the amount of heat generated in a portion of the circumferential surface of a drum corresponding to the lifter, thereby reducing energy loss and preventing breakage of the lifter and a method of controlling the same.

According to an embodiment of the present invention, it is possible to provide a laundry treatment apparatus that is capable of controlling the output of an induction module to prevent overheating of a lifter regardless of the rotation angle of a drum, thereby enhancing safety and efficiency and effectively utilizing the output of the induction module and a method of controlling the same.

According to an embodiment of the present invention, it is possible to provide a laundry treatment apparatus that is capable of uniformly heating a space in which laundry is accommodated by performing heating not only on a drum but also on a lifter. In particular, it is possible to provide a laundry treatment apparatus that is capable of preventing overheating of a lifter by lowering the heating temperature of a portion of a drum in which the lifter is mounted relative to that of a remaining portion of the drum in which the lifter is not mounted and capable of increasing heating efficiency by allowing heat transfer through the lifter and a method of controlling the same.

According to an embodiment of the present invention, it is possible to provide a laundry treatment apparatus that is enhanced in stability and efficiency while minimizing changes in the shape and structure of a conventional drum and lifter and a method of controlling the same.

What is claimed is:

1. A laundry treatment apparatus comprising:

a drum configured to rotate within the laundry treatment apparatus and to accommodate laundry therein, the drum formed of a metal material;

an induction module configured to be spaced apart from an outer circumferential surface of the drum and configured to heat the drum via induction using a magnetic field that is generated in a state in which current is applied to a coil in the induction module;

a lifter that is provided in the drum and that is configured to revolve around an axis of rotation of the drum and to agitate the laundry inside the drum as the drum rotates; and a module controller, comprising at least one processor, that is configured to control an output of the induction module to control an amount of heat generated at the circumferential surface of the drum, wherein the module controller is configured to variably control the amount of heat that is generated based on a position of the lifter as the drum rotates.

2. The laundry treatment apparatus according to claim 1, wherein the module controller is further configured to perform control to generate a first amount of heat in the drum based on the position of the lifter being within a first threshold region around the induction module, and to generate a second amount of heat, greater than the first amount of heat, in the drum based on the position of the lifter being outside of the first threshold region around the induction module.

3. The laundry treatment apparatus according to claim 2, wherein the lifter is mounted on an inner surface of the drum and protrudes inward into an interior of the drum.

4. The laundry treatment apparatus according to claim 3, further comprising:

a magnet provided in the drum at a first location of the drum that is fixed relative to a mounting location of the lifter, the magnet configured to revolve around the axis of rotation of the drum in accordance with the rotation of the drum; and a sensor provided at a second location outside the drum and configured to sense the position of the lifter by sensing a change in a position of the magnet as the drum rotates.

5. The laundry treatment apparatus according to claim 4, wherein the sensor comprises at least one of a reed switch or a hall sensor configured to generate different outputs according to whether the magnet is sensed by the sensor.

6. The laundry treatment apparatus according to claim 5, wherein the lifter comprises a plurality of lifters provided along a circumferential direction of the drum, wherein the magnet comprises a plurality of magnets having a same number as the plurality of lifters, each of the plurality of magnets corresponding to a respective one of the lifters, and wherein the sensor is configured to sense the position of each of the plurality of magnets as the drum rotates, and to transmit an output to the module controller.

7. The laundry treatment apparatus according to claim 5, further comprising a main controller, comprising at least one processor, that is configured to control a driving of a motor that rotates the drum, wherein the main controller is configured to communicate with the module controller.

8. The laundry treatment apparatus according to claim 7, wherein the lifter comprises a plurality of lifters provided along a circumferential direction of the drum, wherein the magnet is provided only in a singular number, wherein the sensor is configured to sense the position of the magnet as the drum rotates and to transmit an output to the main controller, and wherein the main controller is configured to estimate a position of each of the plurality of lifters based on the output of the sensor and based on a rotation angle of the drum.

9. The laundry treatment apparatus according to claim 3, wherein the circumferential surface of the drum is formed with an embossing pattern that is repeated along the circumferential surface, except at a portion of the circumferential surface of the drum on which the lifter is mounted.

10. The laundry treatment apparatus according to claim 9, wherein the module controller is further configured to estimate the position of the lifter based on a change in power or current of the induction module caused by presence or absence of the embossing pattern passing by the induction module as the drum rotates.

11. A method of controlling a laundry treatment apparatus comprising: a drum configured to rotate within the laundry treatment apparatus and to accommodate laundry therein, the drum formed of a metal material; an induction module configured to be spaced apart from an outer circumferential surface of the drum and configured to heat the drum via induction using a magnetic field that is generated in a state in which current is applied to a coil in the induction module; a lifter that is provided in the drum and that is configured to revolve around an axis of rotation of the drum and to agitate the laundry inside the drum as the drum rotates; and a module controller, comprising at least one processor, that is configured to control an output of the induction module to control an amount of heat generated at the circumferential surface of the drum, the method comprising:

operating the induction module to generate the magnetic field;

controlling, by the module controller, the induction module to generate a first output;

determining a position of the lifter as the drum rotates; and determining whether to reduce, by the module controller, the output of the induction module from the first output to a second output based on the position of the lifter that is determined.

12. The method according to claim 11, wherein determining whether to reduce the output of the induction module from the first output to the second output is further based on at least one operating characteristic of the laundry treatment apparatus other than the position of the lifter.

13. The method according to claim 12, wherein determining whether to reduce the output of the induction module from the first output to the second output comprises:

determining to reduce the output of the induction module from the first output to the second output based on a rotational speed of the drum not exceeding a threshold speed.

14. The method according to claim 11, wherein determining whether to reduce the output of the induction module from the first output to the second output based on the position of the lifter comprises:

determining to reduce the output of the induction module based on a position of the lifter being within a threshold region around the induction module.

15. The method according to claim 14, wherein reducing the output of the induction module comprises turning off the induction module.

16. The method according to claim 11, further comprising sensing a value of current flowing in the induction module or a power of the induction module, wherein determining the position of the lifter comprises estimating the position of the lifter based on a change in the value of the current or the power.

17. The method according to claim 11, wherein the laundry treatment apparatus further comprises:

a magnet provided in the drum at a first location of the drum that is fixed relative to a mounting location of the lifter, the magnet configured to revolve around the axis of rotation of the drum in accordance with the rotation of the drum; and a sensor provided at a second location outside the drum and configured to sense the position of the lifter by sensing a change in a position of the magnet as the drum rotates, wherein determining the position of the lifter comprises sensing the position of the lifter based on an output value of the sensor.

18. The method according to claim 11, wherein the lifter comprises a plurality of lifters provided along a circumferential direction of the drum at fixed intervals, wherein the laundry treatment apparatus comprises:

a single magnet provided at a first location in the drum that is fixed relative to a mounting location of a first lifter among the plurality of lifters, and that is configured to revolve around the axis of rotation of the drum in accordance with the rotation of the drum; and a sensor provided at a second location outside the drum and configured to sense a first position of the first lifter by sensing a change in the position of the single magnet as the drum rotates, and wherein determining the position of the lifter comprises sensing the first position of the first lifter based on an output value of the sensor, and estimating at least one second position of a remaining at least one second lifter among the plurality of lifters, based on a rotation angle of the drum or a rotation angle of a motor that drives the drum.

19. The method according to claim 11, wherein determining whether to reduce the output of the induction module from the first output to the second output is performed based on whether the position of the lifter is within a threshold region around the induction module.

* * * * *